US012648682B2

(12) United States Patent
Kim et al.

(10) Patent No.: US 12,648,682 B2
(45) Date of Patent: Jun. 9, 2026

(54) DISHWASHER AND METHOD FOR CONTROLLING SAME

(71) Applicant: SAMSUNG ELECTRONICS CO., LTD., Suwon-si (KR)

(72) Inventors: Sojeong Kim, Suwon-si (KR); Woojin Shin, Suwon-si (KR); Jongwook Kwon, Suwon-si (KR); Johannes Büsing, Suwon-si (KR); Jinhan Kim, Suwon-si (KR); Jihyeon Pak, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 69 days.

(21) Appl. No.: 18/379,916

(22) Filed: Oct. 13, 2023

(65) Prior Publication Data

US 2024/0032769 A1 Feb. 1, 2024

Related U.S. Application Data

(63) Continuation of application No. PCT/KR2022/004126, filed on Mar. 24, 2022.

(30) Foreign Application Priority Data

Apr. 16, 2021 (KR) ..... 10-2021-0050104

(51) Int. Cl.
*A47L 15/48* (2006.01)
*A47L 15/00* (2006.01)
*A47L 15/42* (2006.01)

(52) U.S. Cl.
CPC ..... *A47L 15/486* (2013.01); *A47L 15/0026* (2013.01); *A47L 15/0028* (2013.01);
(Continued)

(58) Field of Classification Search
None
See application file for complete search history.

(56) References Cited

U.S. PATENT DOCUMENTS 6,694,990 B2 * 2/2004 Spanyer ..... A47L 15/0034 134/113
7,093,604 B2 8/2006 Jung et al.
(Continued)

FOREIGN PATENT DOCUMENTS

CN 108814515 A 11/2018
JP 2008-148795 7/2008
(Continued)

OTHER PUBLICATIONS

International Search Report dated Aug. 1, 2022 issued in PCT Application No. PCT/KR2022/004126.
(Continued)

*Primary Examiner* — Rita P Adhlakha
(74) *Attorney, Agent, or Firm* — STAAS & HALSEY LLP

(57) ABSTRACT

A dishwasher including a tub forming a washing chamber; a drying device disposed outside of the tub and including an inlet through which air from the washing chamber is introduceable, a flow channel in which air from the washing chamber introduced through the inlet flows, a fan that is operable to cause air from the washing chamber to be introduced through the inlet to flow in the flow channel, a heater in the flow channel to heat air in the flow channel, an outlet through which air in the flow channel is discharged to the washing chamber, and a temperature sensor between the heater and the outlet; and at least one processor configured to operate the fan based on a start of a drying cycle and to
(Continued)

determine an initial operation time point of the heater during the drying cycle based on temperature detected by the temperature sensor.

17 Claims, 17 Drawing Sheets

(52) U.S. Cl.
CPC ..... *A47L 15/0034* (2013.01); *A47L 15/0044* (2013.01); *A47L 15/0047* (2013.01); *A47L 15/4257* (2013.01); *A47L 15/4287* (2013.01); *A47L 15/4293* (2013.01); *A47L 2301/04* (2013.01); *A47L 2401/18* (2013.01); *A47L 2401/26* (2013.01); *A47L 2501/11* (2013.01); *A47L 2501/12* (2013.01); *A47L 2501/30* (2013.01)

(56) References Cited

U.S. PATENT DOCUMENTS

| | | | |
|---|---|---|---|
| 9,635,997 | B2 | 5/2017 | Lee et al. |
| 10,470,640 | B2 | 11/2019 | Ryu et al. |
| 11,241,140 | B2 | 2/2022 | Jung et al. |
| 11,375,873 | B2 | 7/2022 | Ryu et al. |
| 2004/0200508 | A1 | 10/2004 | Jung et al. |
| 2005/0126601 | A1 | 6/2005 | Jung et al. |
| 2013/0152974 | A1 | 6/2013 | Lee et al. |
| 2016/0157299 | A1 | 6/2016 | De Souza |
| 2017/0105595 | A1 | 4/2017 | Lambert et al. |
| 2017/0188777 | A1 | 7/2017 | Kim et al. |
| 2017/0196431 | A1 | 7/2017 | Hong |
| 2020/0100644 | A1 | 4/2020 | Kopera |

FOREIGN PATENT DOCUMENTS

| | | | |
|---|---|---|---|
| JP | 2008-284094 | | 11/2008 |
| JP | 4817461 | | 11/2011 |
| JP | 5385204 | | 1/2014 |
| JP | 2019-80603 | | 5/2019 |
| JP | 2019-115569 | | 7/2019 |
| JP | 2020-58461 | | 4/2020 |
| KR | 1991-0011212 | | 8/1991 |
| KR | 1993-0009567 | | 6/1993 |
| KR | 10-2016-0025342 | | 3/2016 |
| KR | 10-2016-0034976 | | 3/2016 |
| KR | 10-2017-0062942 | | 6/2017 |
| KR | 10-2017-0081477 | | 7/2017 |
| KR | 10-2018-0003313 | | 1/2018 |
| KR | 108742458 | A | 11/2018 |
| KR | 10-2005442 | | 7/2019 |
| KR | 10-2020-0063419 | | 6/2020 |
| WO | WO 2020/074176 | A1 | 4/2020 |

OTHER PUBLICATIONS

Written Opinion Report dated Aug. 1, 2022 issued in PCT Application No. PCT/KR2022/004126.

U.S. Appl. No. 18/373,411, filed Sep. 27, 2033, Sojeong Kim, Samsung Electronics Co., Ltd.

Office Action dated Jul. 4, 2024 issued in European Application No. EP 22 78 8289.

Office Action dated May 29, 2024 issued in Korean Application No. 10-2023-0128038.

Office Action dated Aug. 12, 2025, in U.S. Appl. No. 18/373,411.

* cited by examiner

FIG. 17

| CLASSIFICATION / COURSE/OPTION | RINSING WATER TARGET TEMPERATURE (℃) |
|---|---|
| FIRST WASHING COURSE | A |
| SECOND WASHING COURSE | B |
| FIRST WASHING COURSE + FIRST OPTION | A + A1 |
| SECOND WASHING COURSE + FIRST OPTION | B + B1 |
| FIRST WASHING COURSE + SECOND OPTION | A +A2 |
| SECOND WASHING COURSE + SECOND OPTION | B + B2 |

DISHWASHER AND METHOD FOR CONTROLLING SAME

CROSS REFERENCE TO RELATED APPLICATIONS

This application is a continuation of International Application No. PCT/KR2022/004126, filed Mar. 24, 2022, and claims foreign priority to Korean application No. 10-2021-0050104, filed Apr. 16, 2021, the disclosures of which are incorporated herein by reference in their entireties.

BACKGROUND

1. Field

The present disclosure relates to a dishwasher, and more specifically, to a dishwasher capable of efficiently drying dishes in a washing chamber and a method for controlling the dishwasher.

2. Description of Related Art

In general, a dishwasher is a device for washing and drying stored dishes by spraying washing water at a high pressure. The dishwasher is operated in such a way that washing water is sprayed at high pressure into a washing chamber in which dishes are stored, and the sprayed washing water comes into contact with the dishes to wash foreign substances such as food waste on a surface of the dishes.

Particularly, the dishwasher may include a washing cycle, a rinsing cycle, and a drying cycle. During the drying cycle, the water on the dishes evaporates and condensed water may be generated in a tub. If a heater is used during the drying cycle, it is possible to obtain not only a quick drying effect, but also a sterilization effect by using heated air.

In the conventional manner using heated air, the structure for heating the air may be complicated, or contaminants in the washing chamber may be introduced into a drying device. Accordingly, there is a demand for a dishwasher that has a simple internal structure to easily discharge condensed water, which is generated during the drying cycle, and that prevents contaminants from flowing into a drying device.

SUMMARY

In accordance with various embodiments of the disclosure, a dishwasher may include a tub forming a washing chamber; a drying device disposed outside of the tub, the drying device including an inlet through which air is introduceable from the washing chamber, a flow channel in which air from the washing chamber introduced through the inlet flows; a fan that is operable to cause air from the washing chamber to be introduced through the inlet to flow in the flow channel, a heater in the flow channel to heat air in the flow channel, an outlet through which air in the flow channel is discharged to the washing chamber, and a temperature sensor between the heater and the outlet to detect a temperature of air in the flow channel; and at least one processor configured to operate the fan based on a start of a drying cycle and to determine an initial operation time point of the heater during the drying cycle based on the temperature detected by the temperature sensor.

In accordance with various embodiments of the disclosure, the at least one processor may be configured to control on/off of the heater to prevent the temperature detected by the temperature sensor from exceeding a reference temperature during the drying cycle.

In accordance with various embodiments of the disclosure, the at least one processor may be configured to control on/off of the heater so that a period during which the heater may be turned on is longer than a period during which the heater may be turned off.

In accordance with various embodiments of the disclosure, the at least one processor may be configured to, in response to the temperature detected by the temperature sensor with the heater in an ON state exceeding the reference temperature, turn off the heater for a remaining time of the drying cycle.

In accordance with various embodiments of the disclosure, the at least one processor may be configured to, in response to the temperature detected by the temperature sensor with the heater in an ON state exceeding the reference temperature, end the drying cycle.

In accordance with various embodiments of the disclosure, the at least one processor may be configured to repeat an operation of turning on the heater for a preset on-period and turning off the heater for a preset off-period, and in response to the temperature detected by the temperature sensor with the heater in an ON state exceeding the reference temperature, turn off the heater for a remaining time of the preset on-period of the heater.

In accordance with various embodiments of the disclosure, the at least one processor may be configured to initially operate the heater in response to the temperature detected by the temperature sensor falling below a reference temperature.

In accordance with various embodiments of the disclosure, the at least one processor may be configured to initially operate the heater in response to the temperature detected by the temperature sensor falling below a first reference temperature, control on/off of the heater to prevent the temperature detected by the temperature sensor from exceeding a second reference temperature, and turn off the heater for a remaining time of the drying cycle in response to the temperature detected by the temperature sensor with the heater in an ON state exceeding the second reference temperature.

In accordance with various embodiments of the disclosure, the at least one processor may be configured to, in response to an end of the drying cycle, turn off the heater and operate the fan until the temperature detected by the temperature sensor falls below a reference temperature.

In accordance with various embodiments of the disclosure, the dishwasher may include a door configured to pen and close the washing chamber, and the at least one processor may be configured to, in response to an end of the drying cycle, turn off the heater and in response to the temperature detected by the temperature sensor falling below a reference temperature, open the door.

In accordance with various embodiments of the disclosure, the at least one processor may be configured to operate the fan for a preset time after opening of the door.

In accordance with various embodiments of the disclosure, the at least one processor may be configured to operate the fan for a preset time by a preset number of times before a start of the drying cycle.

In accordance with various embodiments of the disclosure, the at least one processor may be configured to, upon determining that the fan malfunctions before a start of the drying cycle, omit the drying cycle.

In accordance with various embodiments of the disclosure, the dishwasher may further include a user interface configured to receive a first user input for selecting a first washing course, a second user input for adding the drying cycle for a selected washing course, and a third user input for enhancing a drying performance without adding the drying cycle for a selected washing course, wherein the at least one processor may be configured to, in response to receiving the first user input, set a target temperature of rinsing water used in a rinsing cycle to a first temperature, in response to receiving the first user input and the second user input, set a target temperature of the rinsing water to a second temperature higher than the first temperature by a first preset temperature, and in response to receiving the first user input and the third user input, set a target temperature of the rinsing water to a third temperature higher than the first temperature by a second preset temperature, wherein the first preset temperature may lower than the second preset temperature.

In accordance with various embodiments of the disclosure, the dishwasher may further include a user interface configured to receive a first user input for selecting a first washing course, a second user input for selecting a second washing course, a third user input for adding the drying cycle for a selected washing course, wherein the at least one processor may be configured to, in response to receiving the first user input, set a target temperature of rinsing water used in a rinsing cycle to a first temperature; in response to receiving the second user input, set a target temperature of rinsing water used in a rinsing cycle to a second temperature; in response to receiving the first user input and the third user input, set a target temperature of the rinsing water to a third temperature higher than the first temperature by a first preset temperature; and in response to receiving the second user input and the third user input, set a target temperature of the rinsing water to a fourth temperature higher than the second temperature by a second preset temperature, wherein the first preset temperature is different from the second preset temperature.

In accordance with various embodiments of the disclosure, there is provided a method for controlling a dishwasher having a tub forming a washing chamber, a drying device disposed outside of the tub, the drying device including an inlet through which air is introduceable from the washing chamber, a flow channel in which air introduced from the washing chamber through the inlet flows, a fan that is operable to cause air from the washing chamber to be introduced through the inlet to flow in the flow, a heater in the flow channel to heat air in the flow channel, an outlet through which air in the flow channel is discharged to the washing chamber, and a temperature sensor between the heater and the outlet to detect a temperature of air in the flow channel, the method including: operating the fan based on a start of a drying cycle; and determining an initial operation time point of the heater during the drying cycle based on the temperature detected by the temperature sensor.

In accordance with various embodiments of the disclosure, the method may further include controlling on/off of the heater to prevent a temperature measured by the temperature sensor from exceeding a reference temperature during the drying cycle.

In accordance with various embodiments of the disclosure, the controlling of the on/off of the heater may include controlling on/off of the heater such that a period during which the heater may be turned on is longer than a period during which the heater may be turned off.

In accordance with various embodiments of the disclosure, the controlling of the on/off of the heater may include, in response to the temperature measured by the temperature sensor with the heater in an ON state being exceeding the reference temperature, turning off the heater for a remaining time of the drying cycle.

In accordance with various embodiments of the disclosure, the controlling of the on/off of the heater may include repeating an operation of turning on the heater for a preset on-period and turning off the heater for a preset off-period, and in response to the temperature measured by the temperature sensor measured by the temperature sensor with the heater in an ON state being exceeding the reference temperature, turning off the heater for a remaining time of the preset on-period of the heater.

In accordance with various embodiments of the disclosure, the determining of the initial operation time point of the heater may include determining a point in time at which a temperature measured by the temperature sensor falls below a reference temperature as an initial operation time point of the heater.

In accordance with various embodiments of the disclosure, the determining of the initial operation time point of the heater may include determining a point in time at which a temperature measured by the temperature sensor falls below a first reference temperature, and the method further include controlling on/off of the heater to prevent the temperature measured by the temperature sensor from exceeding a second reference temperature, and turning off the heater for a remaining time of the drying cycle in response to the temperature measured by the temperature sensor with the heater in an ON state being exceeding the second reference temperature.

BRIEF DESCRIPTION OF THE DRAWINGS

The above and other aspects, features, and advantages of certain embodiments of the present disclosure will be more apparent from the following description taken in conjunction with the accompanying drawings, in which:

FIG. 17 is a diagram for describing the temperature of rinsing water of a dishwasher according to various embodiments of the present disclosure.

DETAILED DESCRIPTION

The various embodiments of the disclosure and terminology used herein are not intended to limit the technical features of the disclosure to the specific embodiments, but rather should be understood to cover all modifications, equivalents, and alternatives falling within the concept and scope of the disclosure.

In the following detailed description, the terms of "front side", "rear side", "left side", "right side" and the like may be defined by the drawings, but the shape and the location of the component is not limited by the term.

Various embodiments of the present disclosure provide a dishwasher including a drying device having a simple air circulation structure.

Various embodiments of the present disclosure provide a dishwasher capable of improving drying effect of dishes in a washing chamber with optimal energy efficiency and a method for controlling the dishwasher.

Various embodiments of the present disclosure provide a dishwasher capable of reducing the time required for a drying cycle and a method for controlling the dishwasher.

Various embodiments of the present disclosure provide a dishwasher capable of preventing a safety accident that may occur due to hot air discharged during a drying cycle and a method for controlling the dishwasher.

Various embodiments of the present disclosure provide a dishwasher including a drying device capable of increasing a drying effect of dishes in a washing chamber.

According to various embodiments of the present disclosure, a dishwasher can efficiently improve the drying effect of dishes in the washing chamber using minimal energy.

According to various embodiments of the present disclosure, a dishwasher can shorten the time required for the drying cycle.

According to various embodiments of the present disclosure, a dishwasher can prevent a safety accident that may occur due to hot air discharged during the drying cycle.

Figure 1:
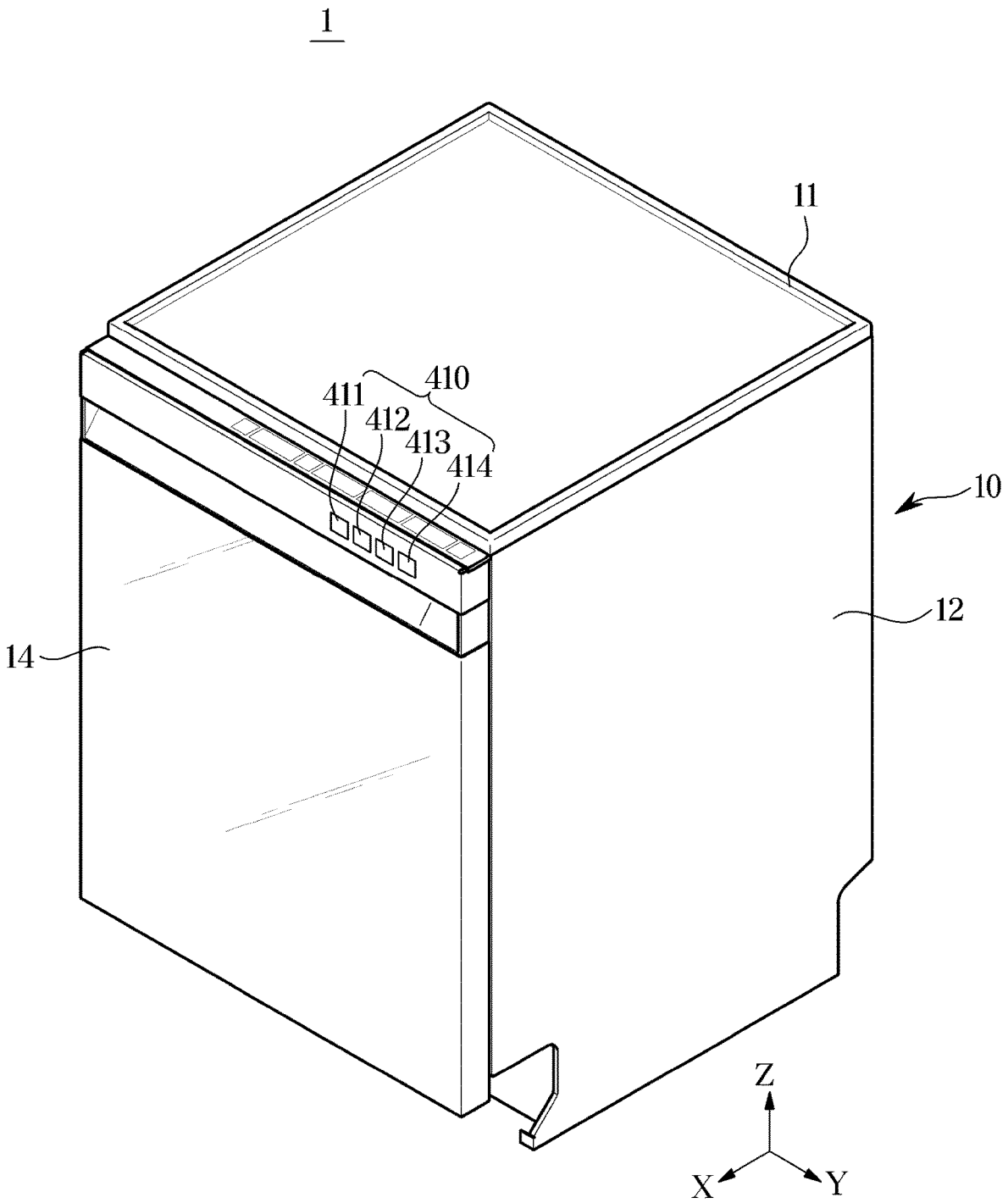
FIG. 1 is a perspective view illustrating a dishwasher according to various embodiments.
Figure 2:
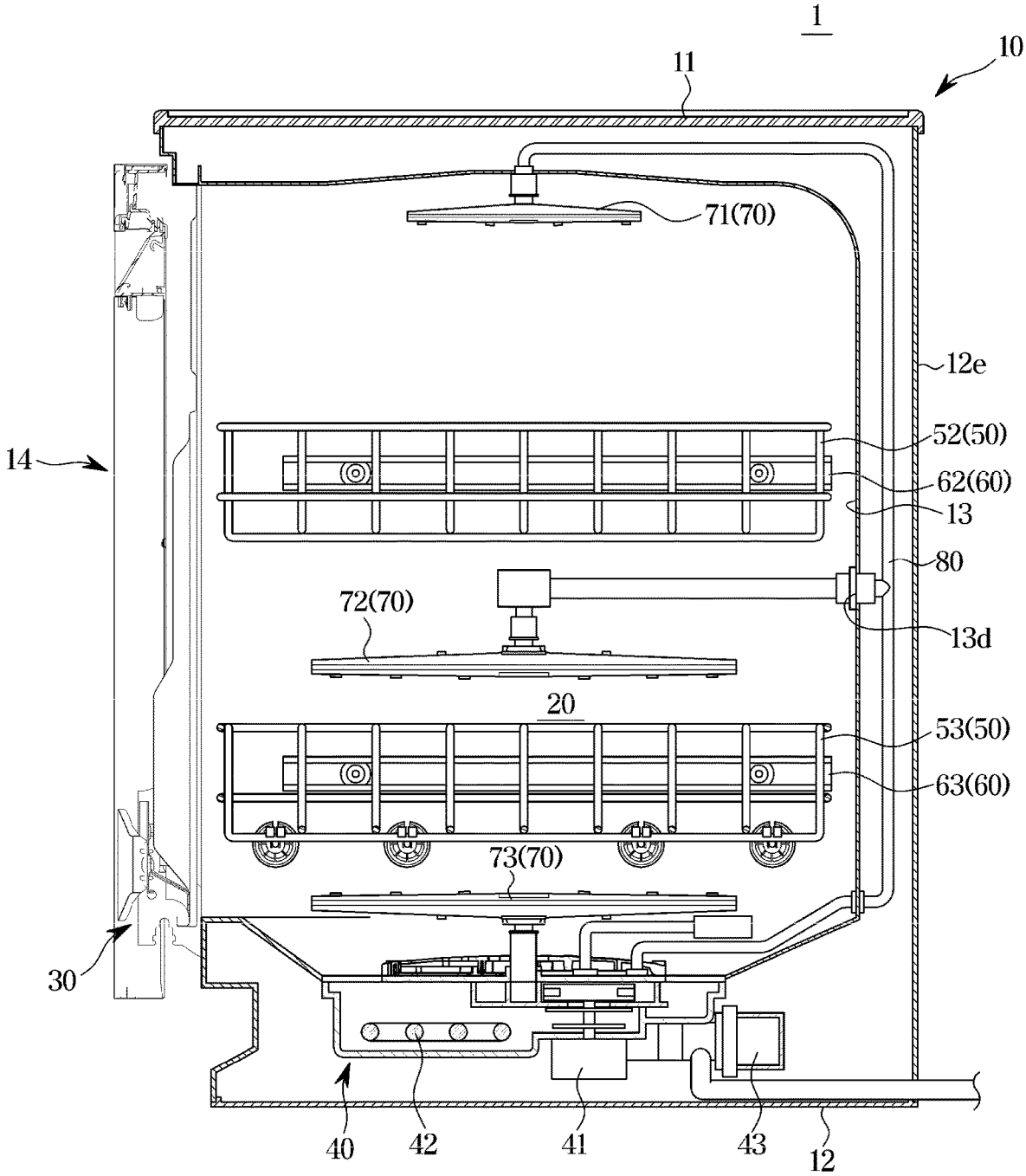
FIG. 2 is a side cross-sectional view of the dishwasher according to FIG. 1.
Figure 3:
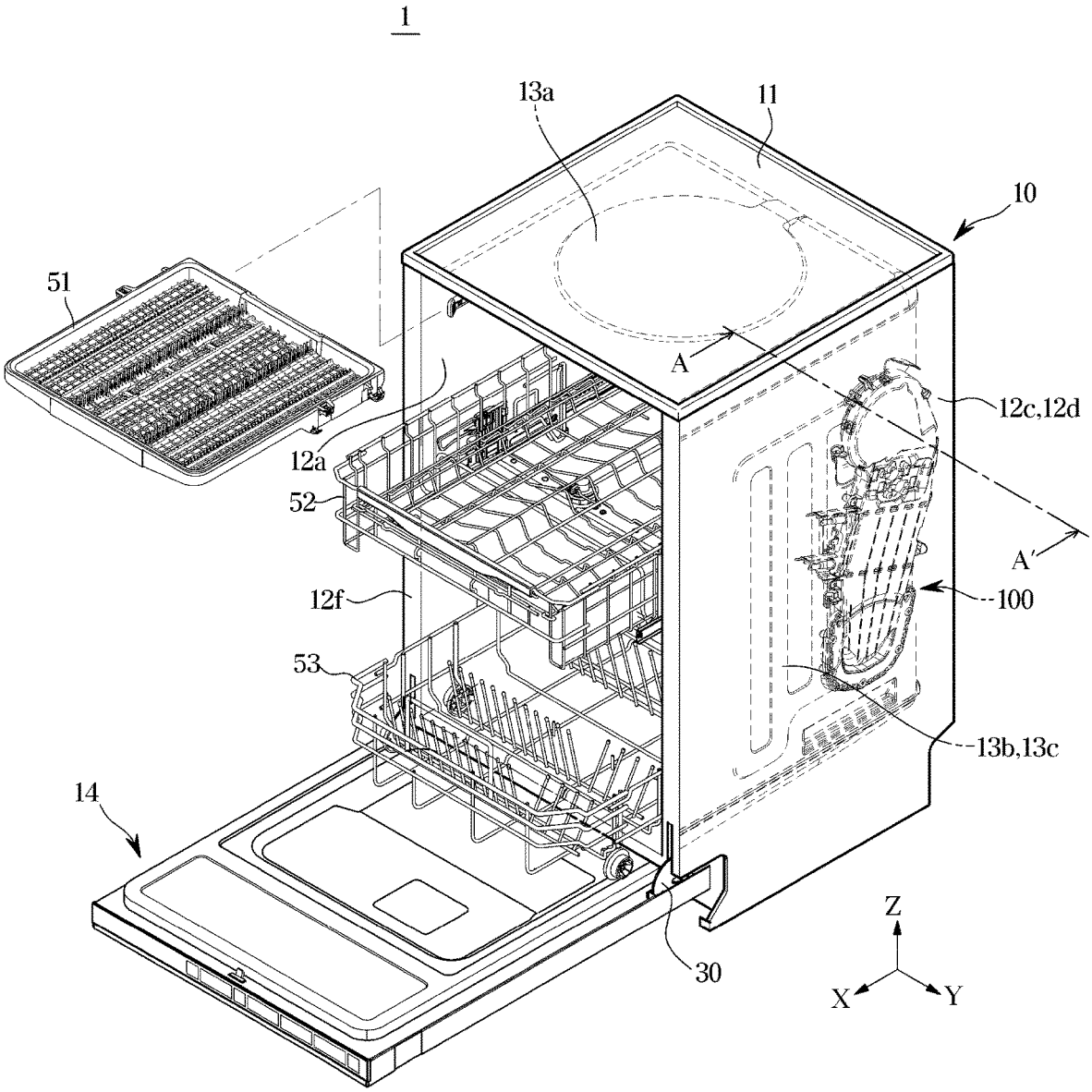
FIG. 3 is a perspective view illustrating a state in which a door is opened in the dishwasher according to FIG. 1.

FIG. 1 is a perspective view illustrating a dishwasher according to various embodiments. FIG. 2 is a side cross-sectional view of the dishwasher according to FIG. 1. FIG. 3 is a perspective view illustrating a state in which a door is opened in the dishwasher according to FIG. 1.

Referring to FIGS. 1 to 3, a dishwasher 1 may include a main body 10. The main body 10 may include a cabinet 12 forming an exterior, a tub 13 arranged inside the main body 10 and forming a washing chamber 20, and a door 14 installed in the cabinet 12 and configured to open and close the tub 13. However, the dishwasher 1 may be provided in a built-in form, and in this case, the cabinet 12 may be omitted.

The cabinet 12 may be provided in a substantially box shape. One side of the cabinet 12 may be opened. That is, the cabinet 12 may include an opening 12*a*. As an example, a front surface of the cabinet 12 may be opened.

An input module 410 (411, 412, 413, and 414) for receiving various commands from a user may be provided on one side of the cabinet 12.

The cabinet 12 and the tub 13 are provided in the shape of a hexahedron in which substantially one surface is opened so as to serve as an opening. The main body 10 may include a top cover 11 provided on an upper side of the cabinet 12.

The cabinet 12 may include a rear plate 12*e*, both side plates 12*c* and 12*d* extending to one side and the other in front of the rear plate 12*e*, and a front plate 12*f* formed to be bent from the both side plates 12*c* and 12*d*. The front plate 12*f* may be provided to form the opening 12*a* in the front of the cabinet 12. The door 14 may be configured to open and close the opening 12*a* of the front plate 12*f*. It is illustrated that the front plate 12*f* is integrally extended from the both side plates 12*c* and 12*d* according to an embodiment of the invention, but is not limited thereto.

The door 14 may be rotatably installed in the main body 10 (e.g., the cabinet 12). The door 14 may be rotatably hinged to a lower end of the cabinet 12. The door 14 may be coupled to the cabinet 12 by a hinge device 30.

In an embodiment, the door 14 may be opened by a door opening device (not shown). The door opening device (not shown) may include a driving motor for generating driving force for opening the door and a driving circuit supplying driving power to the driving motor according to an electrical signal.

Inside the cabinet 12, a sump unit 40 is arranged below the tub 13 to store water used for washing, and a plurality of baskets 50 provided to be withdrawable from an inside of the cabinet 12 to an outside thereof and in which a dish is placed, a guide rack 60 provided to support the plurality of baskets 50, and a plurality of spray nozzles 71, 72 and 73 configured to spray water, which is delivered from the sump unit 40, toward the dish contained in the plurality of baskets 50.

Relatively large dishes may be accommodated in the plurality of baskets 50. There is no limitation in the types and sizes of dishes accommodated in the plurality of baskets 50. The types of dishes accommodated in the plurality of baskets 50 may include relatively large or small dishes.

The plurality of baskets 50 may include a first basket 51, a second basket 52, and a third basket 53. The first basket 51 may be coupled to the tub 13 at an upper portion of the tub 13 so as to be located above the second basket 52 and the third basket 53. The first basket 51 may be located above the second basket 52. The second basket 52 may be coupled to the tub 13 at a middle portion of the tub 13 so as to be located below the first basket 51 and/or above the third basket 53. The third basket 53 may be coupled to the tub 13 at a lower portion of the tub 13 to be located below the first and second baskets 51 and 52. The first basket 51 may correspond to a sub-basket 51 in which a dish having a relatively small volume is accommodated. A small cup such as an espresso cup may be accommodated in the sub basket 51. However, the types of dishes accommodated in the sub-basket 51 are not limited to the above example.

The dishwasher 1 may include a first guide rack 61 provided to support the first basket 51, a second guide rack 62 provided to support the second basket 52, and a third guide rack 63 provided to support the third basket 53 in the tub 13.

The guide racks 61, 62, and 63 may correspond to rails for withdrawing out the baskets 51, 52 and 53, respectively.

The first guide rack 61, the second guide rack 62 and the third guide rack 63 may be installed on inner walls 13*b* and 13*c* of the tub 13 to allow the first basket 51, the second basket 52 and the third basket 53 to be slide toward the front surface of the tub 13. For example, the guide rack 60 may be installed on a left wall 13*b* and a right wall 13*c* of the tub 13.

The first basket 51, the second basket 52, and the third basket 53 may slide in a front and rear direction of the tub 13 along the first guide rack 61, the second guide rack 62, and the third guide rack 63.

The sump unit 40 may be arranged at a lower center of the cabinet 12 to collect washing water used for washing. The sump unit 40 may include a washing pump 41 configured to pump the stored water to a spray unit 70. The washing water pumped by the washing pump 41 may be supplied to a first spray nozzle 71, a second spray nozzle 72, and a third spray nozzle 73 through a supply pipe 80.

The dishwasher 1 may further include a washing water heater 42 arranged in a lower portion of the cabinet 12 to heat the washing water, and a drain pump 43 arranged below the tub 13 to drain the washing water.

The dishwasher 1 may include the spray unit 70 configured to spray washing water. The spray unit 70 may include the first spray nozzle 71 arranged above the first basket 51, the second spray nozzle 72 arranged above the first basket 51 and the second basket 52, that is, arranged between the second basket 52 and the third basket 53, and the third spray nozzle 73 arranged below the third basket 53.

The first spray nozzle 71 is configured to be rotatable. The first spray nozzle 71 may spray the washing water toward the dishes stored in the first basket 51 and/or the second basket 52. The second spray nozzle 72 is configured to be rotatable. The second spray nozzle 72 is configured to spray the washing water toward the dishes stored in the second basket 52 and the third basket 53. The third spray nozzle 73 is configured to be rotatable. The third spray nozzle 73 is configured to spray the washing water toward the dishes stored in the third basket 53.

The dishwasher may include a drying device 100. The drying device 100 may be coupled to an outer wall of the tub 13. For example, the drying device 100 may be coupled to one of the sidewalls 13*b* and 13*c* of the tub 13. Therefore, there is little possibility that water falling from the dishes is introduced into an inside of the drying device 100 when the basket 50 is moved. Alternatively, the drying device 100 may be coupled to an upper wall 13*a* or a rear wall 13*d* of the tub 13. The drying device 100 may heat the air in the washing chamber 20 to lower a relative humidity of the air. Details will be described below.

Figure 4:
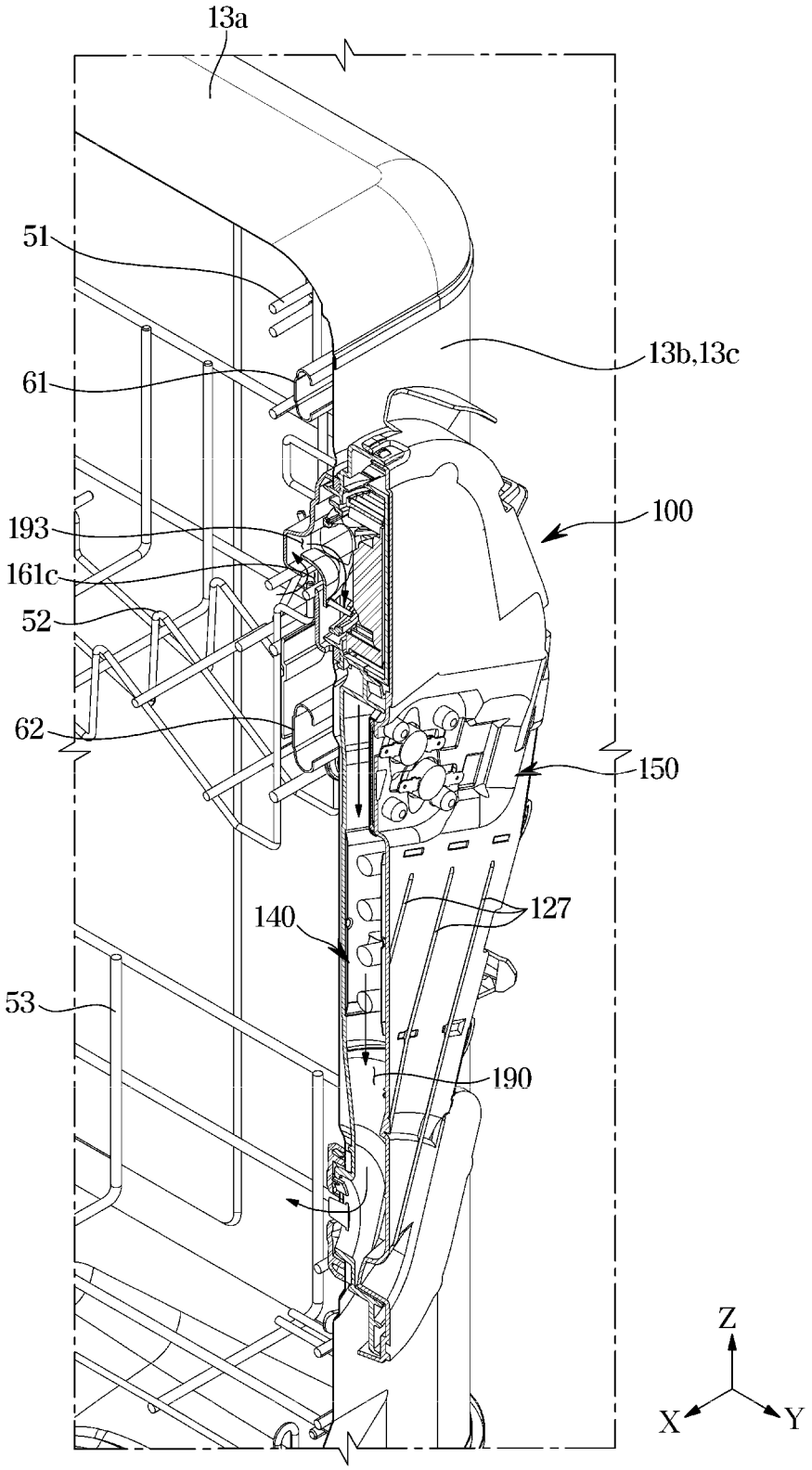
FIG. 4 is a cross-sectional perspective view of the dishwasher shown in FIG. 3.
Figure 5:
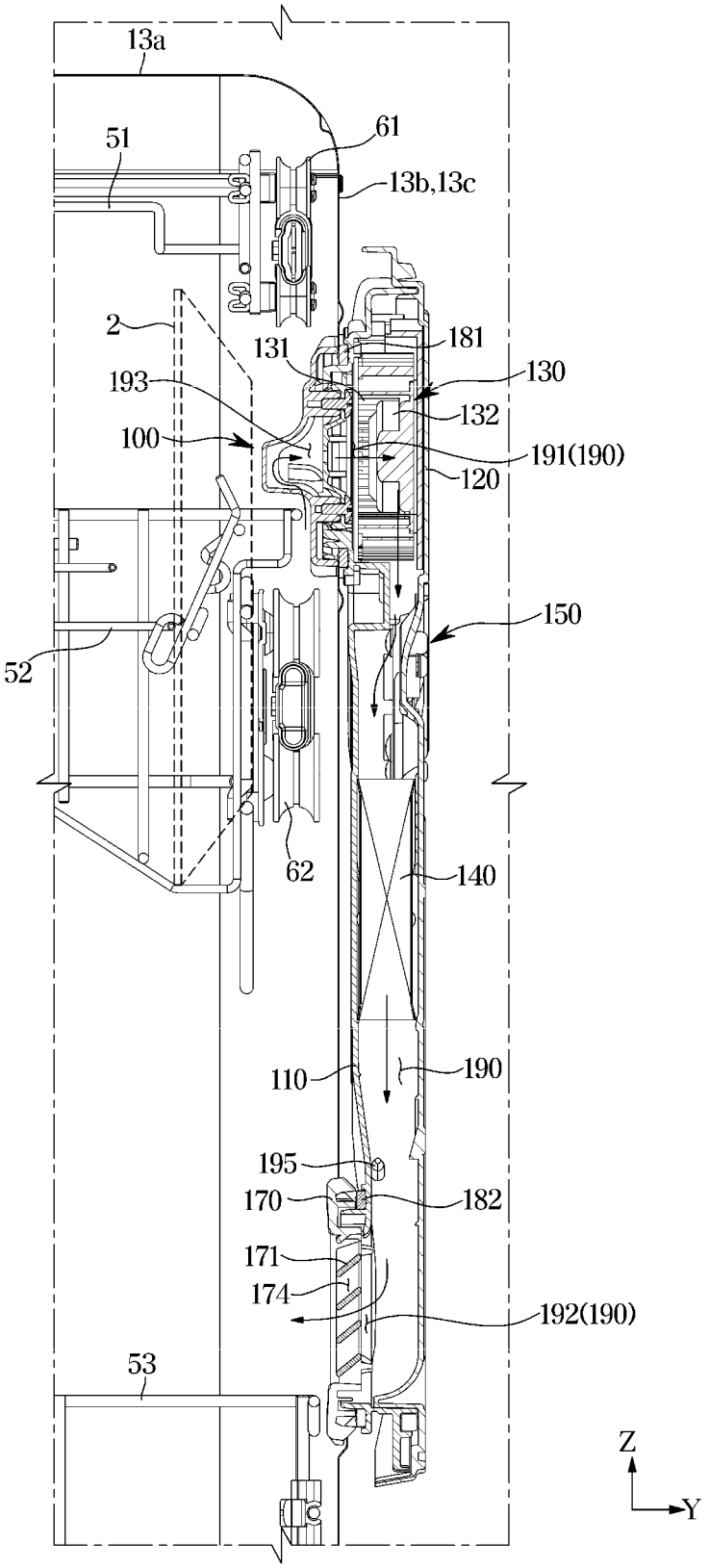
FIG. 5 is a cross-sectional view of the dishwasher shown in FIG. 4.

FIG. 4 is a cross-sectional perspective view of the dishwasher shown in FIG. 3. FIG. 5 is a cross-sectional view of the dishwasher shown in FIG. 4. FIGS. 4 and 5 illustrate a cross-section taken along line A-A' of FIG. 3.

Referring to FIGS. 4 and 5, the dishwasher 1 may include the drying device 100. The drying device 100 may be arranged on the sidewalls 13*b* and 13*c* of the tub 13. For example, the drying device 100 may be arranged between an outer surface of the tub 13 and an inner surface of the cabinet 12. The drying device 100 may be coupled to the sidewalls 13*b* and 13*c* of the tub 13. The drying device 100 and an inlet cover 161 may be arranged adjacent to the rear wall 13*d* of the tub 13. The baskets 51, 52, and 53 may be movable in the front and rear directions by the guide racks 61, 62, and 63. Because the inlet cover 161 is arranged adjacent to the rear wall 13*d*, it is possible to minimize interference with the movement of the baskets 51, 52, and 53 caused by the inlet cover 161. Particularly, a dish 2 may be accommodated in the second basket 52, and the dish 2 may interfere with the inlet cover 161 in response to the second basket 52 being moved forward and backward. In this case, because the inlet cover 161 is adjacent to the rear wall 13*d*, the interference, which is generated by the dish 2 when the second basket 52 is moved, may be minimized. The types of the dish 2 are not limited to those illustrated in the drawings.

In addition, the inlet cover 161 may be arranged below the first guide rack 61 and/or above the second guide rack 62. The inlet cover 161 may be arranged between the first guide rack 61 and the second guide rack 62. For example, the inlet cover 161 may be arranged between the first basket 51 and the second basket 52. The arrangement of the inlet cover 161 may minimize interference with the movement of the first and second baskets 51 and 52.

Further, the dishwasher may include a height adjuster (not shown) provided adjacent to the sidewalls 13*b* and 13*c* of the tub. The height adjuster may be configured to adjust a height at which the second basket 52 is inserted into the washing chamber 20. For example, the height of the second basket 52 may be increased toward the first basket 51 or may be decreased toward the third basket 53. However, even if the height of the second basket 52 is changed, the interference is not generated between the inlet cover 161 and the second basket 52.

The dishwasher 1 may perform a washing cycle for washing a dish in the washing chamber 20, a rinsing cycle for rinsing foreign substances on the dish, and a drying cycle for drying the air in the washing chamber 20 after the rinsing cycle. The relative humidity of the air in the washing chamber 20 may be reduced through the drying cycle. In the disclosure, it is described as "air", but the disclosure is not limited thereto, and it may be equally applied to other fluids such as water according to an embodiment of the invention.

Hereinafter a process, in which air in the washing chamber 20 is intaken into the drying device 100 and discharged from the drying device 100 to the washing chamber 20 again during the drying cycle, will be described.

In response to the start of the drying cycle, a fan 131 in the drying device 100 may be rotated. The fan 131 may intake humid air in the washing chamber 20. The intaken air may flow through a plurality of intakes 161*c* of the inlet cover 161, and an inlet space 193, which is arranged between the inlet cover 161 and an inlet 191, and then flow into the inlet 191. A flow channel 190 may be provided with the inlet 191 and an outlet 192. That is, the air passing through the inlet space 193 may be introduced into the flow channel 190. The fan 131 may allow the intaken air to flow through the inlet 191, the fan 131, a switch device 150, a heater 140, and a temperature sensor 195, which are arranged in the flow channel 190, in order and then flow back to the washing chamber 20. The fan 131 may intake air in the washing chamber 20 into the flow channel 190, and forcefully blow the air in the flow channel 190 to allow the air to flow through the switch device 150 to the heater 140. The fan 131 may be arranged upstream of the switch device 150, the heater 140, and the temperature sensor 195. Accordingly, the fan 131 may blow air to the switch device 150 and the heater 140, and may allow the air to flow back to the washing chamber 20 through the outlet 192. For example, the fan 131 may be arranged above the switch device 150, the heater 140, and the temperature sensor 195. However, the position of the fan 131 is not limited thereto.

The switch device 150 may turn off the heater 140 in response to the air in the flow channel 190 being overheated due to the heater 140. For example, the air may not be cooled due to a failure of the fan 131 or a motor 132, and the heater 140 may continuously heat the air. In this case, the air in the flow channel 190 may be overheated. If the heater 140 is not turned off, housings 110 and 120 formed of plastic may melt due to the overheated air. To prevent this, a switch 151 of the switch device 150 may turn off the heater 140 in response to the air adjacent to the heater 140 reaching a predetermined temperature. However, the operation of the switch device 150 is not limited to the above example. Even if the fan 131 or the motor 132 does not fail, the switch device 150 may turn off the heater 140 in response to the heater 140 being overheated.

The switch device 150 may be arranged upstream of the heater 140. For example, the switch device 150 may be arranged above the heater 140. As the air is heated by the heater 140, the heated air is directed upward. Accordingly, the switch device 150 may be arranged above the heater 140 to detect a temperature of the heater 140, and thus, in response to the air being overheated, the switch device 150 may turn off the heater 140. Accordingly, it is possible to prevent other components of the dishwasher 1 from being damaged. However, the position of the switch device 150 is not limited to the above example.

In an embodiment, the switch device 150 may include a thermostat electrically connected to a power connection terminal 143 of the heater 140.

The heater 140 may heat the air in the flow channel 190. A relative humidity of air heated by the heater 140 may be reduced. The heater 140 may be arranged downstream of the switch device 150. For example, the heater 140 may be arranged below the switch device 150.

The temperature sensor 195 may be arranged downstream of the heater 140 to detect the temperature of the air heated by the heater 140. For example, the temperature sensor 195 may be arranged below the heater 140. However, the position of the heater 140 is not limited to the above example. The temperature sensor 195 may detect the temperature of the heated air and send a signal to a controller (e.g., a processor 200 in FIG. 8). Accordingly, the controller may control the on-off of the heater 140 according to the temperature of the air.

In an embodiment, the temperature sensor 195 may include a thermistor that changes in electrical characteristics with temperature variations to convert a thermal signal into an electrical signal.

To summarize, the air in the washing chamber 20 may be introduced into the flow channel 190 through the inlet 191, and the air in the flow channel 190 may flow through the fan 131, the switch device 150, the heater 140, and the temperature sensor 195 and flow back to the washing chamber 20 through the outlet 192. The outlet 192 may be formed at a lower portion of the housings 110 and 120 to allow condensed water collected in the housings 110 and 120 to flow into the washing chamber 20.

A discharge port 174 may be formed inside an outlet cover 170, and a blade 171 may be provided in the discharge port 174. The blade 171 may be arranged to allow the air in the flow channel 190 to flow to the lower portion of the tub 13. However, the arrangement of the blade 171 is not limited thereto.

Figure 6:
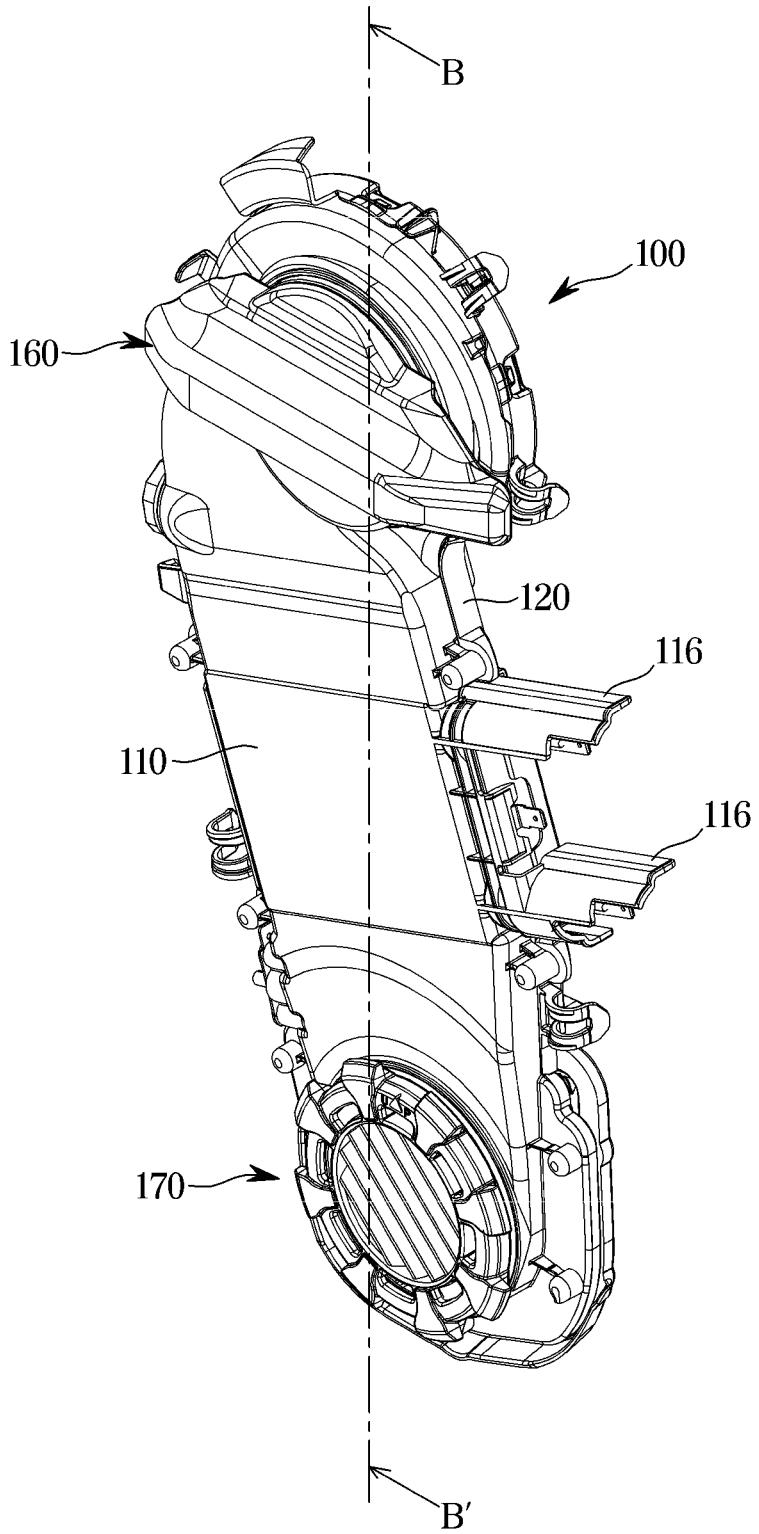
FIG. 6 is a perspective view illustrating a drying device of a dishwasher according to various embodiments.
Figure 7:
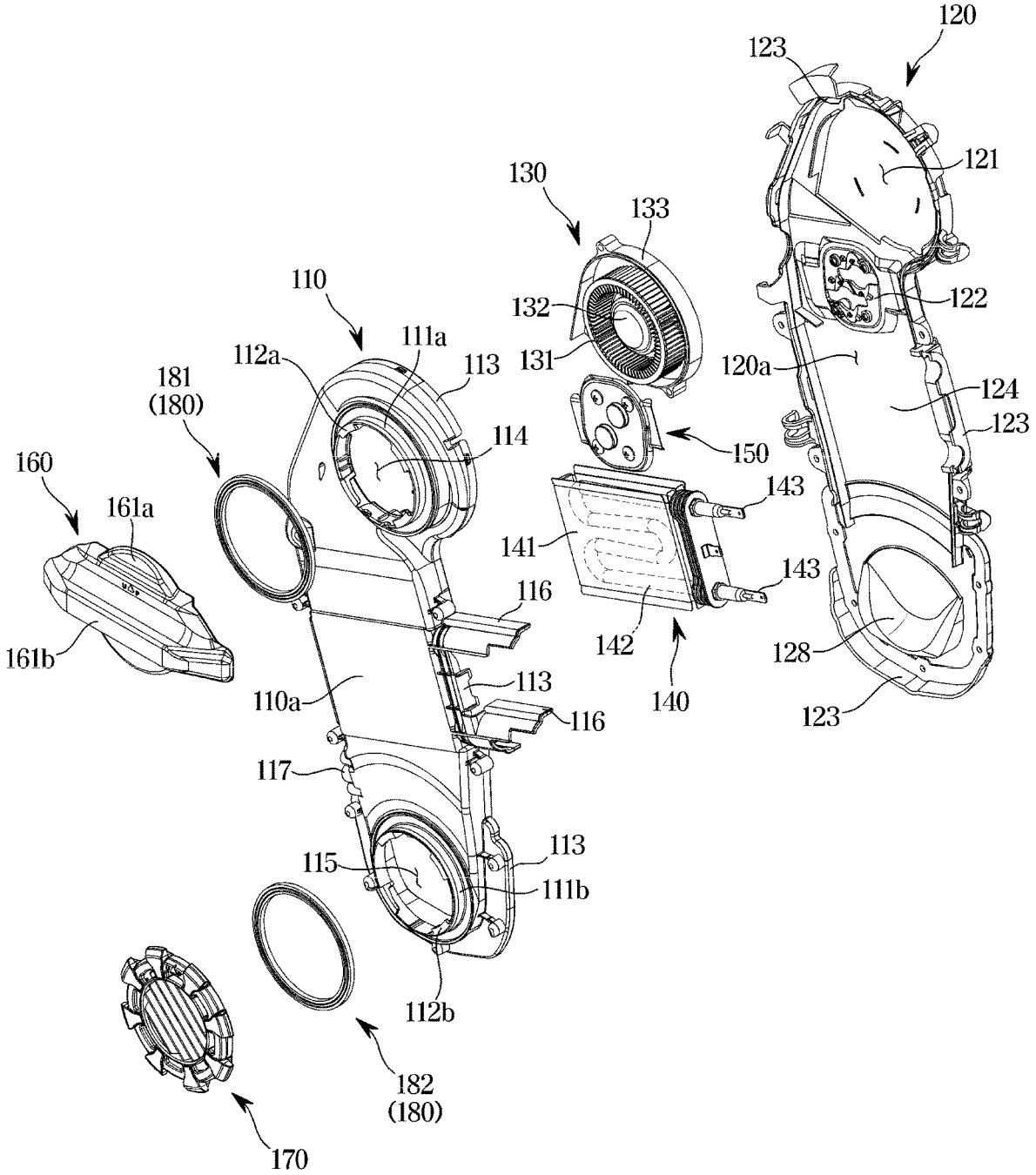
FIG. 7 is an exploded perspective view of a state in which the drying device of the dishwasher shown in FIG. 6 is disassembled.

FIG. 6 is a perspective view illustrating a drying device of a dishwasher according to various embodiments. FIG. 7 is an exploded perspective view of a state in which the drying device of the dishwasher shown in FIG. 6 is disassembled.

Referring to FIGS. 6 and 7, the dishwasher 1 may include the drying device 100. The drying device 100 may include the housings 110 and 120, a fan assembly 130, the heater 140, the switch device 150, and the flow channel 190. Further, the dishwasher 1 may include an inlet cover assembly 160 and the outlet cover 170. However, in the drying device 100, some of the above components may be omitted or some components may be added.

In an embodiment, the drying device 100 may further include an ultraviolet lamp (not shown) for emitting ultraviolet light to air passing through the flow channel 190. The ultraviolet lamp (not shown) may irradiate the flow channel 190 with ultraviolet light to sterilize the flow channel 190, thereby drying the flow channel 190 and blocking moisture in the flow channel 190.

The housings 110 and 120 may extend in a Z direction. For example, the housings 110 and 120 may extend in a vertical direction to accommodate the components of the drying device 100, such as the fan 131, the heater 140, and the switch device 150. Accordingly, because the structure of the housings 110 and 120 is simple, even if condensed water is generated, the condensed water may flow downward and be discharged into the washing chamber 20. The housings 110 and 120 may include a first housing 110 and a second housing 120. The first housing 110 and the second housing 120 may be coupled to each other to form the flow channel 190 therein.

The first housing 110 may be coupled to the sidewalls 13*b* and 13*c* of the tub 13. The first housing 110 may be coupled to the sidewalls 13*b* and 13*c* of the tub 13 by the inlet cover 161 and the outlet cover 170. For example, the inlet cover 161 and the outlet cover 170 may be rotated to be coupled to the first housing 110.

The first housing 110 may include a base 110*a*, a cover coupling portion 111, a receiving rib 112, a housing coupling portion 113, an inlet port 114, an outlet port 115, a terminal protection portion 116 and a temperature sensor receiving portion 117.

The cover coupling portion 111 may include a first cover coupling portion 111*a* to be coupled to the inlet cover assembly 160, and a second cover coupling portion 111*b* to be coupled to the outlet cover 170. The cover coupling portion 111 may protrude from the base 110*a* in a direction toward each cover. The cover coupling portion 111 may be formed in a shape corresponding to the inlet cover assembly 160 or the outlet cover 170. A cover sealing member 180 may be arranged outside the cover coupling portion 111. The cover sealing member 180 may be arranged outside the cover coupling portion 111. In response to the drying device 100 being coupled to the tub 13, the cover sealing member 180 may seal between the drying device 100 and the tub 13.

The housing coupling portion 113 of the first housing 110 may be coupled to a housing coupling portion 123 of the second housing 120 to allow the first housing 110 and the second housing 120 to be coupled to each other. The shape of the first housing coupling portion 113 is not limited to that illustrated in the drawings. In addition, the first housing coupling portion 113 may be arranged in various positions such as an upper portion, a middle portion, a lower portion, etc. of the first housing 110.

The inlet port 114 may be formed to correspond to the inlet 191 of the flow channel 190, and the outlet port 115 may be formed to correspond to the outlet 192 of the flow channel 190.

The terminal protection portion 116 may extend in the X direction from the base 110*a*. For example, the terminal protection portion 116 may extend toward a front upper side (refer to FIG. 3). The terminal protection portion 116 may protect a power connection terminal 143 of the heater 140. The power connection terminal 143 may be arranged on a front upper side to prevent the condensed water in the drying device 100 from flowing to the power connection terminal 143.

The temperature sensor receiving portion 117 may be formed on one side of the first housing 110. The temperature sensor receiving portion 117 may receive the temperature sensor 195 in the first housing 110 to allow the temperature sensor 195 to detect a temperature of the air in the flow channel 190.

The second housing 120 may be coupled to the first housing 110. The second housing 120 may include a base 120*a*, a fan receiving portion 121, a switch device coupling portion 122, a housing coupling portion 123, a heater receiving portion 124, a separation rib 127, a guide portion 128.

The fan receiving portion 121 may receive the fan assembly 130. For example, a seating portion 133 of the fan assembly 130 may be received in the fan receiving portion 121. The fan receiving portion 121 may be coupled to the fan receiving portion 121 through a separate fastening member (not shown).

The switch device coupling portion 122 may be coupled to the switch device 150. Details will be described below. The heater 140 may be mounted on the heater receiving portion 124.

The separation rib 127 may be formed outside the second housing 120. The separation rib 127 may protrude from an outer surface of the second housing 120 toward the cabinet 12 (refer to FIG. 4). The separation rib 127 may allow the outer surface of the second housing 120 and an inner surface of the cabinet to be spaced apart from each other. For example, the separation rib 127 may allow the second housing 120 and the side plate of the cabinet to be spaced apart from each other. Accordingly, a space between the drying device 100 and the cabinet 12 may be formed, and thus it is possible to reduce the transfer of heat that is generated by the heater 140 and transferred to the cabinet 12. In addition, it is possible to allow air to be circulated in the space between the cabinet 12 and the drying device 100. The separation rib 127 may be provided in plurality. In the drawing, the number of separation ribs 127 is shown as four, but the number of separation ribs 127 is not limited thereto.

The guide portion 128 may guide the flow of air to allow the air in the flow channel 190 to flow into the washing chamber 20. The guide portion 128 may protrude toward the first housing 110.

The second housing coupling portion 123 may be coupled to the housing coupling portion 113 of the first housing 110 to allow the first housing 110 and the second housing 120 to be coupled to each other. The shape of the second housing coupling portion 123 is not limited to that illustrated in the drawings. In addition, the second housing coupling portion 123 may be arranged in various positions such as an upper portion, a middle portion, and a lower portion of the second housing 120.

The fan assembly 130 may include the fan 131, the motor 132, and the seating portion 133. The fan 131 may allow air in the washing chamber 20 to flow into the flow channel 190. The fan 131 may be arranged upstream of the switch device 150 and the heater 140 in the flow channel 190. For example, the fan 131 may be arranged in the upper portion of the flow channel 190 (refer to FIGS. 4 and 5). The fan 131 may be a centrifugal fan. However, the position and type of the fan 131 is not limited to the above example. The motor 132 may be connected to the fan 131, thereby driving the fan 131. The fan seating portion 133 may cover the fan 131 and the motor 132 and allow the fan 131 and the motor 132 to be mounted therein. The fan seating portion 133 may be coupled to the fan receiving portion 121 of the second housing 120.

The heater 140 may include a heater case 141, a sheath heater 142, and the power connection terminal 143. The heater case 141 may be integrally formed to receive the sheath heater 142 therein. The heater case 141 may form an exterior of the heater 140 to protect the sheath heater 142 arranged therein. The sheath heater 142 may be a tubular heater. Because the sheath heater 142 is used, even when condensed water is generated in the housings 110 and 120, a difficulty may not occur in terms of the function of the heater. For example, even when condensed water is generated in the housings 110 and 120 due to the washing or rinsing cycle before the drying cycle, the heater 140 may secure the function thereof. The power connection terminal 143 may receive power from the dishwasher 1. The power connection terminal 143 may be connected to both ends of the sheath heater 142 to operate the sheath heater 142. The power connection terminal 143 may be arranged on the front upper side. Accordingly, condensed water may not flow toward the terminal 143 (refer to FIG. 3).

The switch device 150 may be configured to turn off the heater 140 in response to the air in the flow channel 190 being overheated due to the heater 140. For example, the air may not be cooled due to a failure of the fan 131 or the motor 132, and the heater 140 may continuously heat the air. In this case, the air in the flow channel 190 may be overheated. If the heater 140 is not turned off, the housings 110 and 120 formed of plastic may melt due to the overheated air. To prevent this, the switch 151 of the switch device 150 may turn off the heater 140 in response to the air adjacent to the heater 140 reaching the predetermined temperature. However, the operation example of the switch device 150 is not limited to the above example. The switch device 150 may be arranged upstream of the heater 140 (refer to FIG. 5). For example, the switch device 150 may be arranged above the heater 140. As the air is heated by the heater 140, the heated air is directed upward. Accordingly, the switch device 150 may be arranged above the heater 140 to detect the temperature of the heater 140, thereby turning off the heater 140 in response to the air being overheated. However, the position of the switch device 150 is not limited to the above example.

The inlet cover 161 may cover the inlet 191 of the flow channel 190 and the inlet port 114 of the first housing 110. By the inlet cover 161, it is possible to prevent foreign substances or washing water from being introduced into the drying device 100 through the inlet 191 during the washing cycle or the rinsing cycle. The inlet cover 161 may include the base member 161*a* and the protrusion 161*b*. The protrusion 161*b* may protrude from the base member 161*a* into the washing chamber 20 to form the inlet space 193. Air in the washing chamber 20 may be introduced into the flow channel 190 through the inlet space 193.

In the above description, the configuration and structure of the dishwasher 1 according to various embodiments have been described. Hereinafter, a method for controlling a dishwasher 1 according to various embodiments will be described in detail.

Figure 8:
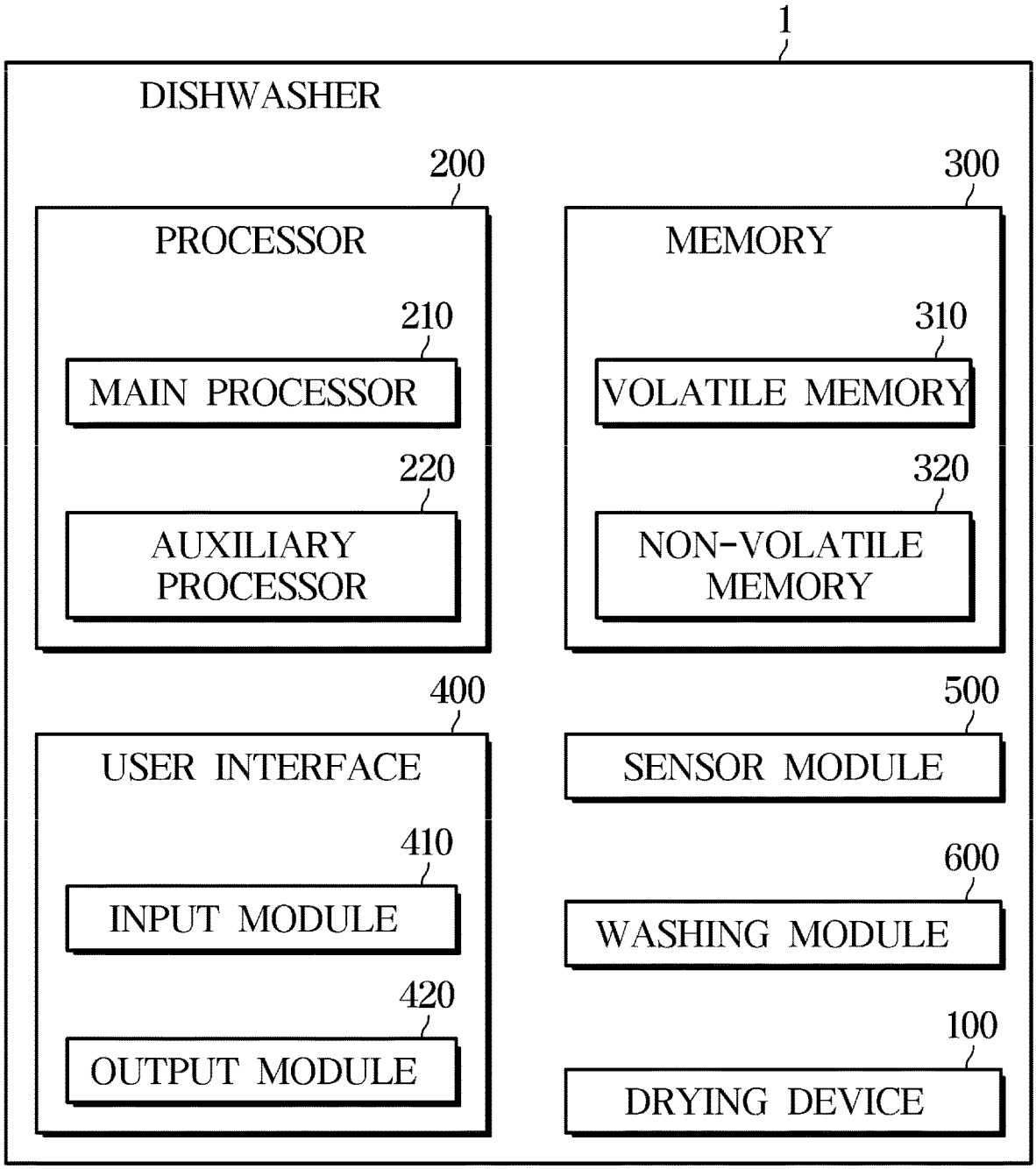
FIG. 8 is a control block diagram of a dishwasher according to various embodiments.

FIG. 8 is a control block diagram of a dishwasher according to various embodiments.

Referring to FIG. 8, the dishwasher 1 according to an embodiment may include a drying device 100, a processor 200, a memory 300, a user interface 400, a sensor module 500, and/or a washing module 600.

The processor 200 may, for example, execute software (e.g., a program) to control at least one other component (e.g., the drying device 100 or the washing module 600) of the dishwasher 1 connected to the processor 200, and may perform various data processing or calculation. According to an embodiment, as at least part of data processing or calculation, the processor 200 may store commands or data received from other components (e.g., the sensor module 500) in a volatile memory 310, process the commands or data stored in the volatile memory 310, and store resultant data in a non-volatile memory 320. According to an embodiment, the processor 200 may include a main processor 210 (e.g., a central processing unit) or an auxiliary processor 220 (e.g., a processor for controlling the drying device 100 or a processor for controlling of the washing module) that may operate independently or together with the main processor. For example, when the dishwasher 1 includes the main processor 210 and the auxiliary processor 220, the auxiliary processor 220 may use less power than the main processor 210 or be set to be specialized for a designated function. The auxiliary processor 220 may be implemented separately from or as part of the main processor 210. However, the processor 200 is not limited to including any particular number of processors, and/or any division of specialization between different processors. Therefore, the processor 200 can be a single processor or multiple processors.

The memory 300 may store various types of data used by at least one component (e.g., the processor 200 or the sensor module 500) of the dishwasher 1. The data may include, for example, software and input data or output data regarding instructions related to the software. The memory 300 may include the volatile memory 310 or the non-volatile memory 320.

The user interface 400 may include an input module 410 that receives various commands or data and an output module 420 that outputs various types of information to a user.

The input module 410 may receive a command or data to be used in a component (e.g., the processor 200) of the dishwasher 1 from the outside (e.g., a user) of the dishwasher 1. The input module 410 may include, for example, a microphone, a key (e.g., a button), or a touch pad.

The input module 410 may include a plurality of buttons or a plurality of touch pads, and each of the buttons or each of the touch pads may correspond to a command to be used for a different component of the dishwasher 1.

In an embodiment, the input module 410 may include a first button (e.g., 411 in FIG. 1) for receiving a first user input for selecting a first washing course, a second button (e.g., 412 in FIG. 1) for receiving a second user input for selecting a second washing course, a third button (e.g., 413 in FIG. 1) for adding a hot air drying option, a fourth button (e.g., 414 in FIG. 1) for adding a drying enhancement option, and the like.

When the input module 410 (411, 412, 413, and 414) is implemented as a button (or a touch pad) that receives a tactile input, the input module 410 may be located on a upper surface of the door 14 and/or a front surface of the door 14 to facilitate a user's manipulation. However, the location of the input module 410 may be changed without limitation according to embodiments.

According to various embodiments, the input module 410 may be implemented as at least one microphone that receives an audio input.

The output module 420 may notify the current state of the dishwasher 1, the current state of a component (e.g., the drying device 100) of the dishwasher 1) and the like to the outside (e.g., the user). For example, when a supply of power to the heater 140 is cut off by the switch device 150, the processor 200 may control the output module 420 to notify the outside that the drying device 100 malfunctions.

In an embodiment, the output module 420 may include a speaker for outputting sound and/or a display module for outputting an image. The display module may include, for example, a display, a hologram device, or a projector, and a control circuit for controlling the corresponding device.

The sensor module 500 may be configured to detect an environmental state (e.g., the degree of dish contamination) of the dishwasher 1, an environmental state (e.g., the temperature of washing water of the flow channel 190) of the washing module 600, and generate an electrical signal or data value corresponding to the detected state.

In an embodiment, the sensor module 500 may include a temperature sensor 195 disposed downstream of the heater 140 to sense the temperature of air heated in the heater 140 of the drying device 100 and/or a washing water temperature sensor (not shown) disposed in the sump unit 40 to sense the temperature of washing water.

In another embodiment, the sensor module 500 may include a camera module (not shown) that acquires image data for identifying the degree of contamination of dishes stored in the washing chamber 20.

In some embodiments, in the dishwasher 1, at least one of the components (e.g., the output module 420) may be omitted, or one or more other components may be added.

For example, the dishwasher 1 may further include a communication module (not shown) for establishing a direct (wired) communication channel with external electronic devices (e.g., a smartphone or a server) or a wireless communication channel, and supporting communication execution through the established communication channel.

Figure 9:
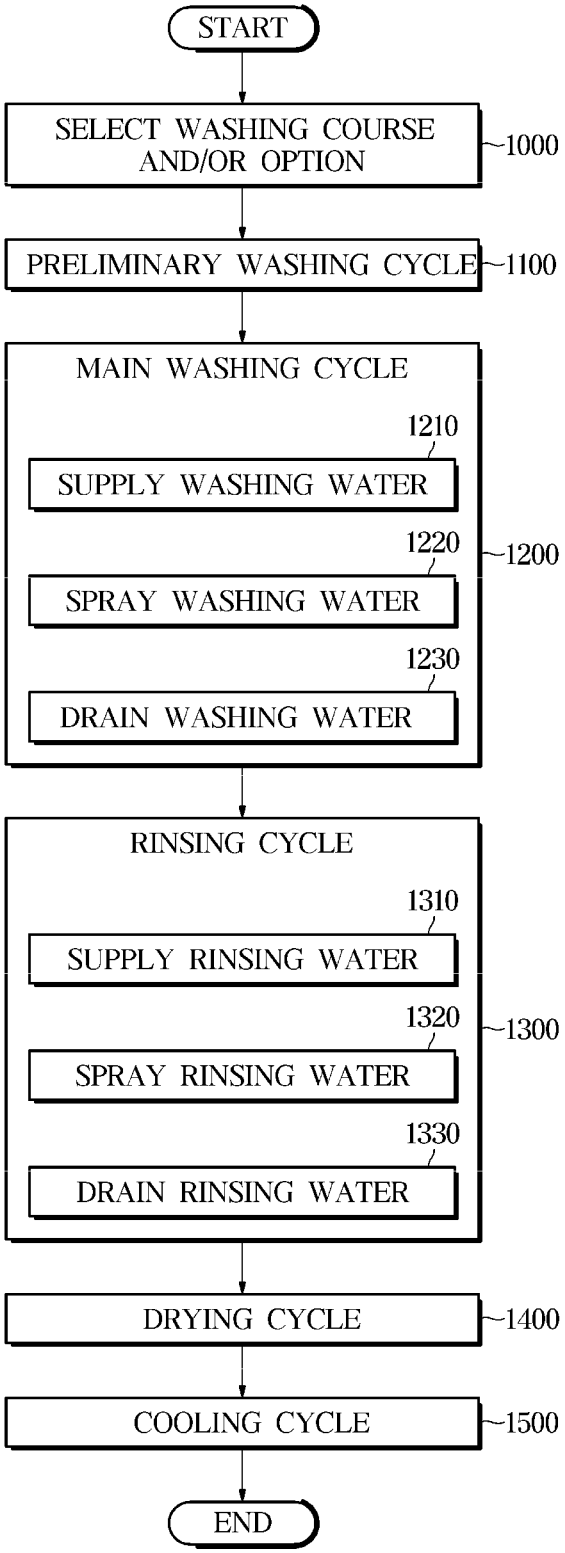
FIG. 9 illustrates an example of a washing course of a dishwasher according to various embodiments.

FIG. 9 illustrates an example of a washing course of a dishwasher 1 according to various embodiments.

Referring to FIG. 9, a user may select a washing course and/or a washing option through the input module 410 of the user interface 400, and the processor 200 may retrieve commands or data corresponding to the user input (1000).

In an embodiment, the washing course may include various courses, such as an automatic course, a standard course, an intensive course, a glassware course, a rapid course, a rinse dry course, or an internal wash course.

Depending on the type of washing course, the washing sequence, the water consumption, the washing temperature, and/or the washing required time may vary.

For example, when an automatic course is selected, the dishwasher 1 may perform a cycle that is suitable for the degree of dish contamination identified through the sensor module 500. As another example, when a standard course is selected, the dishwasher 1 may perform only a main washing cycle (1200) and a rinsing cycle (1300) without a preliminary washing cycle (1100) to be described below.

As another example, when an intensive course is selected, the dishwasher 1 may perform all of the preliminary cycle (1100), the main washing cycle (1200), and the rinsing cycle (1300).

In an embodiment, the washing option may refer to an option for adding another cycle to a selected washing course or partially changing settings of a selected washing course.

For example, the washing option may include an option (hereinafter referred to as "hot air drying option") for adding a drying cycle to a selected washing course and an option (hereinafter referred to as "drying enhancement option") for increasing the temperature of rinsing water without adding a drying cycle to the selected washing course to improve the drying performance.

For example, when it is assumed in a standard course that the temperature of rinsing water in the rinsing cycle is set to 55° C., adding a drying enhancement option to the standard course may cause the temperature of rinsing water to be changed to 80° C.

In an embodiment, when adding a drying enhancement option d to the standard course, a cooling cycle (1500) may be added after the rinsing cycle (1300).

In an embodiment, the hot air drying option and/or the drying enhancement option may be set by default, and accordingly, the input module 410 may further include a button for receiving a user input for inactivating the hot air drying option and/or the drying enhancement option.

In the specification, a "drying cycle" may refer to a cycle of supplying hot air to the washing chamber 20 using the fan 131 and the heater 140 of the drying device 100. In the specification, a cycle of circulating air by operating only the fan 131 of the drying device 100 may be defined as a cooling cycle.

The dishwasher 1 may, in response to receiving a selection of a washing course and a washing option, perform cycles corresponding thereto.

In FIG. 9, for convenience of description, all cycles performable in the dishwasher 1 are shown, but some cycles may be omitted or some cycles may be added depending on the washing course and washing option.

In an embodiment, the dishwasher 1 may perform a preliminary washing cycle (1100).

The preliminary washing cycle (1100) is a cycle for removing relatively large contaminants present in dishes by spraying washing water not mixed with detergent into the washing chamber 20 before the main washing cycle (1200).

In an embodiment, the dishwasher 1 may perform the main washing cycle (1200) after performing the preliminary washing cycle (1100).

The main washing cycle (1200) may include a washing water supplying cycle (1210) for providing washing water to be used for washing to the sump unit 40, a washing water spraying cycle (1220) for spraying washing water mixed with detergent through the spray unit 70 or heating washing water and supplying the heated washing water through the spray unit 70, and/or a washing water draining cycle (1230) for draining the washing water stored in the sump unit 40 and/or the spray unit 70.

In an embodiment, the dishwasher 1 may perform a rinsing cycle (1300) after performing the main washing cycle (1200).

The rinsing cycle (1300) may include a rinsing water supplying cycle (1310) for providing the rinsing water used for rinsing to the sump unit 40, a rinsing water spraying cycle (1320) for spraying the rinsing water stored in the sump unit 40 through the spray unit 70, or heating the rinsing water and spraying the heated rinsing water through the spray unit 70, and a rinsing water draining cycle (1330) for draining the rinsing water stored in the sump unit 40 and/or the spray unit 70.

In the rinsing water spraying cycle (1320), rinsing water may be sprayed into the washing chamber 20 a plurality of times.

When the temperature of the rinsing water is high, the dishes may be heated in the rinsing cycle (1300), and after the rinsing cycle (1300) is finished, the dishes may be efficiently dried by the latent heat of the dishes.

In an embodiment, the temperature of the rinsing water sprayed into the washing chamber 20 in the rinsing cycle (1300) may be higher than that of the washing water sprayed into the washing chamber 20 in the main washing cycle (1200) and/or the preliminary washing cycle (1100).

According to various embodiments, the temperature of the rinsing water used in the last rinsing water spraying operation of the rinsing water spraying cycle (1320) may be higher than the temperature of the rinsing water used in the previous rinsing water spraying operations.

In an embodiment, the dishwasher 1 may perform a drying cycle (1400) after performing the rinsing cycle (1300).

The drying cycle (1400) is a cycle for drying dishes by circulating air inside the washing chamber 20 and supplying hot air to the inside of the washing chamber 20 using the drying device 100.

In an embodiment, the dishwasher 1 may perform a cooling cycle (1500) after performing the drying cycle (1400).

The cooling cycle (1500) is a cycle for preventing safety accidents by lowering the temperature inside the washing chamber 20, and may be performed using the drying device 100.

According to various embodiments, the cooling cycle 1500 may be defined as a part of the drying cycle 1400.

Figure 10:
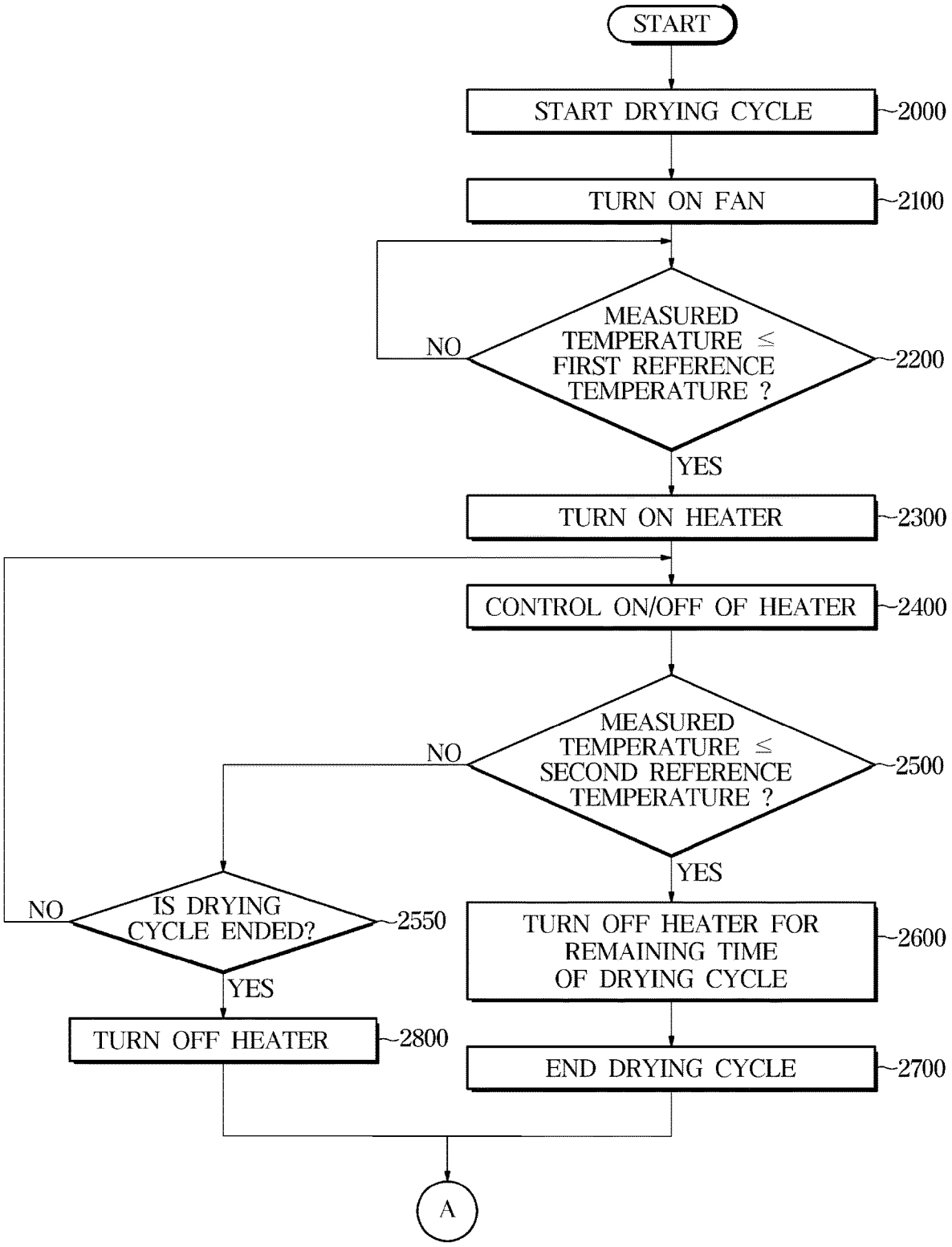
FIG. 10 is a flowchart showing a method for controlling a dishwasher during a drying cycle, according to various embodiments of the present disclosure.
Figure 11:
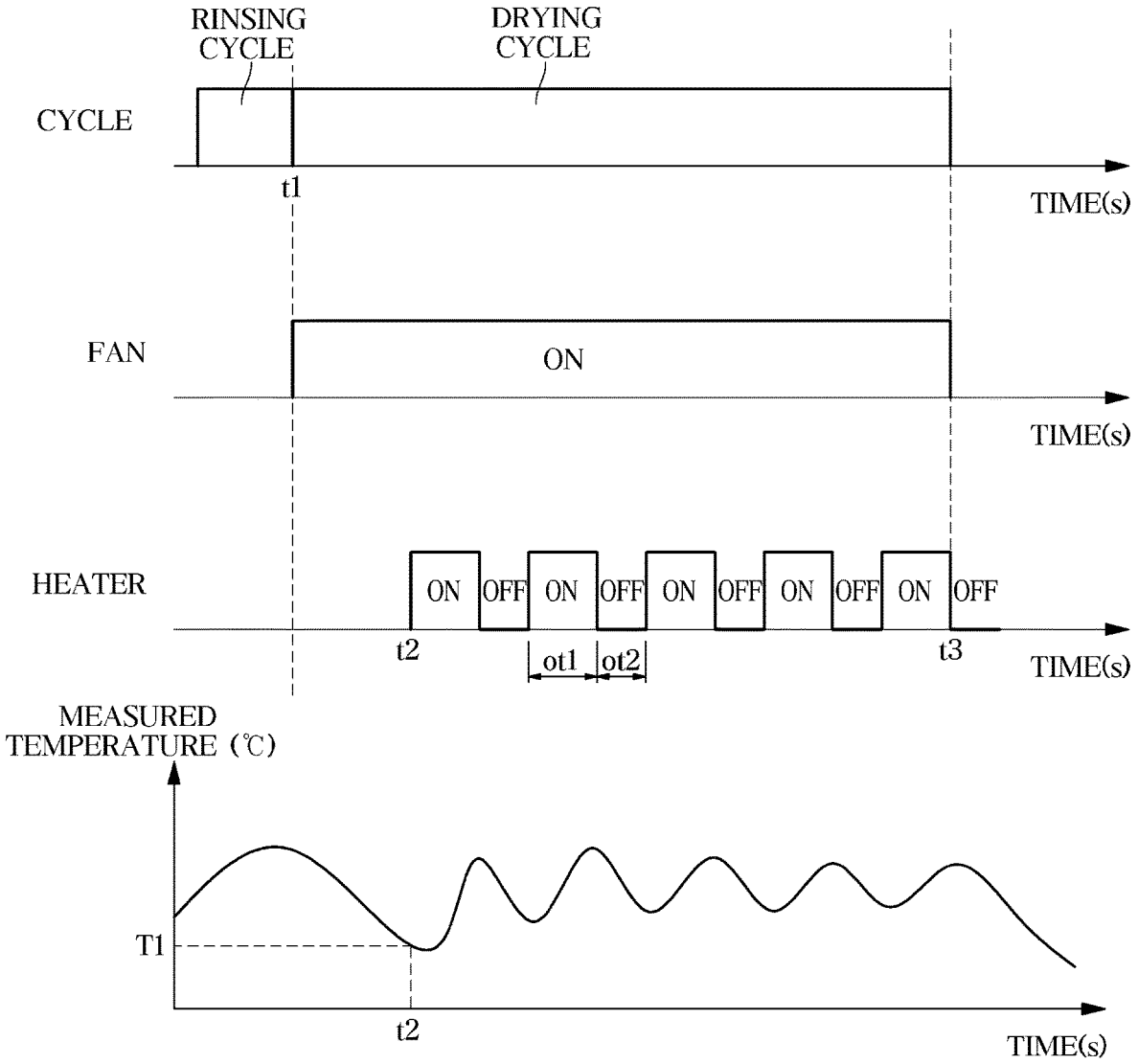
FIG. 11 illustrates an example of an operation of a drying device during a drying cycle of a dishwasher according to various embodiments.
Figure 12:
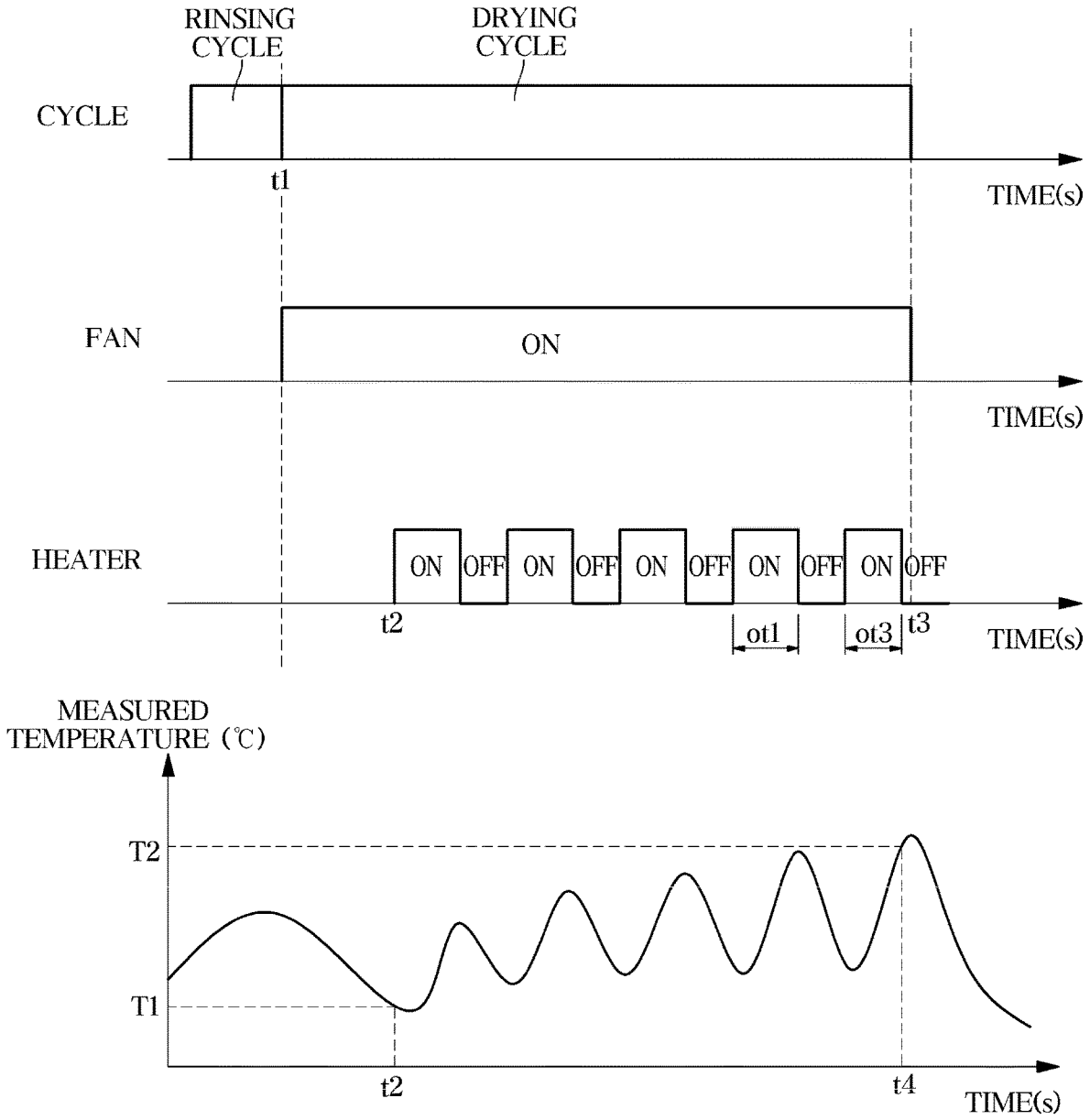
FIG. 12 is a diagram for describing a state in which a reference temperature is exceeded while a heater is in ON-state during a drying cycle of a dishwasher according to various embodiments.
Figure 13:
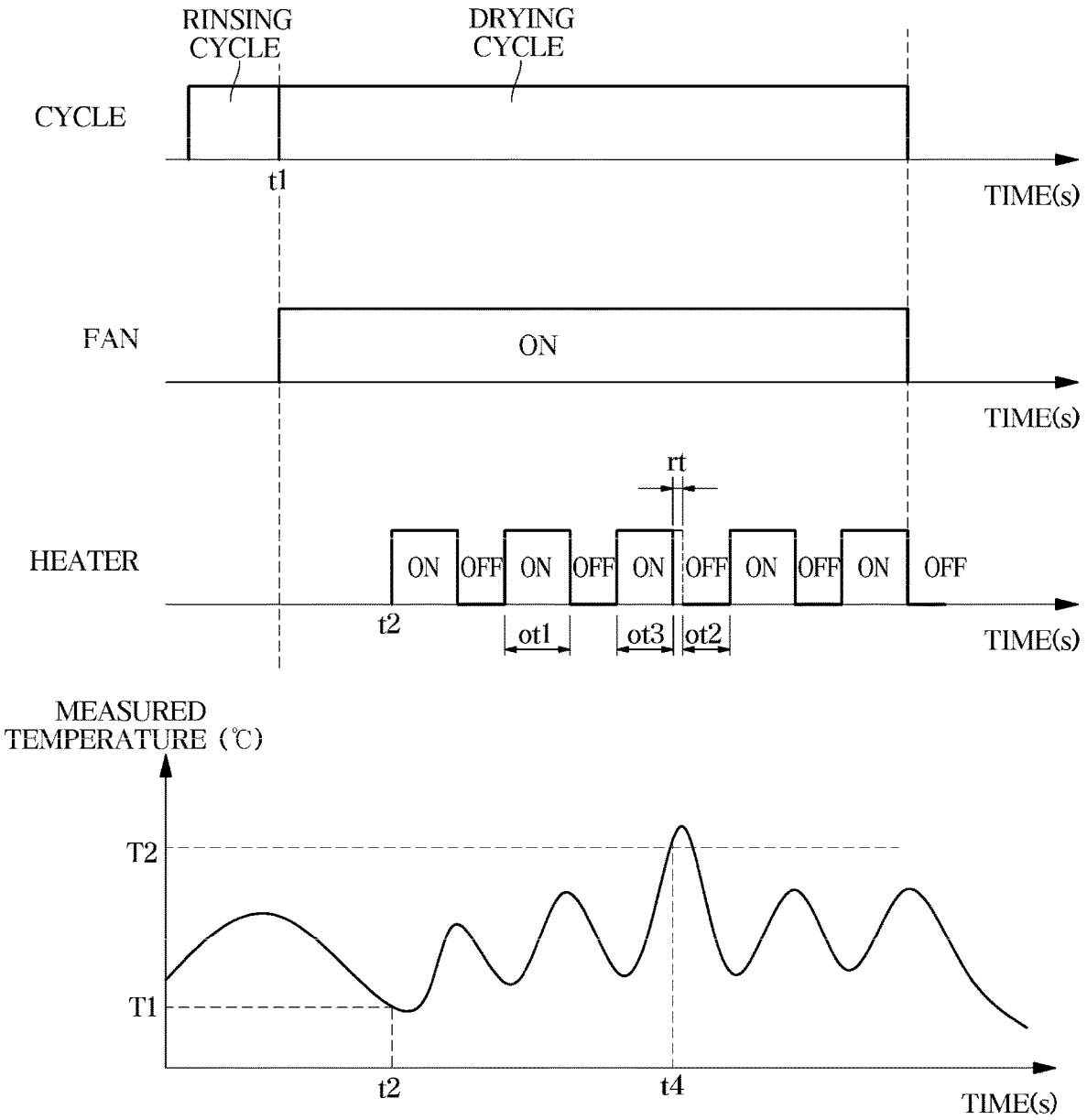
FIG. 13 is another embodiment illustrating a state in which a reference temperature is exceeded while a heater is in ON-state during a drying cycle.
Figure 14:
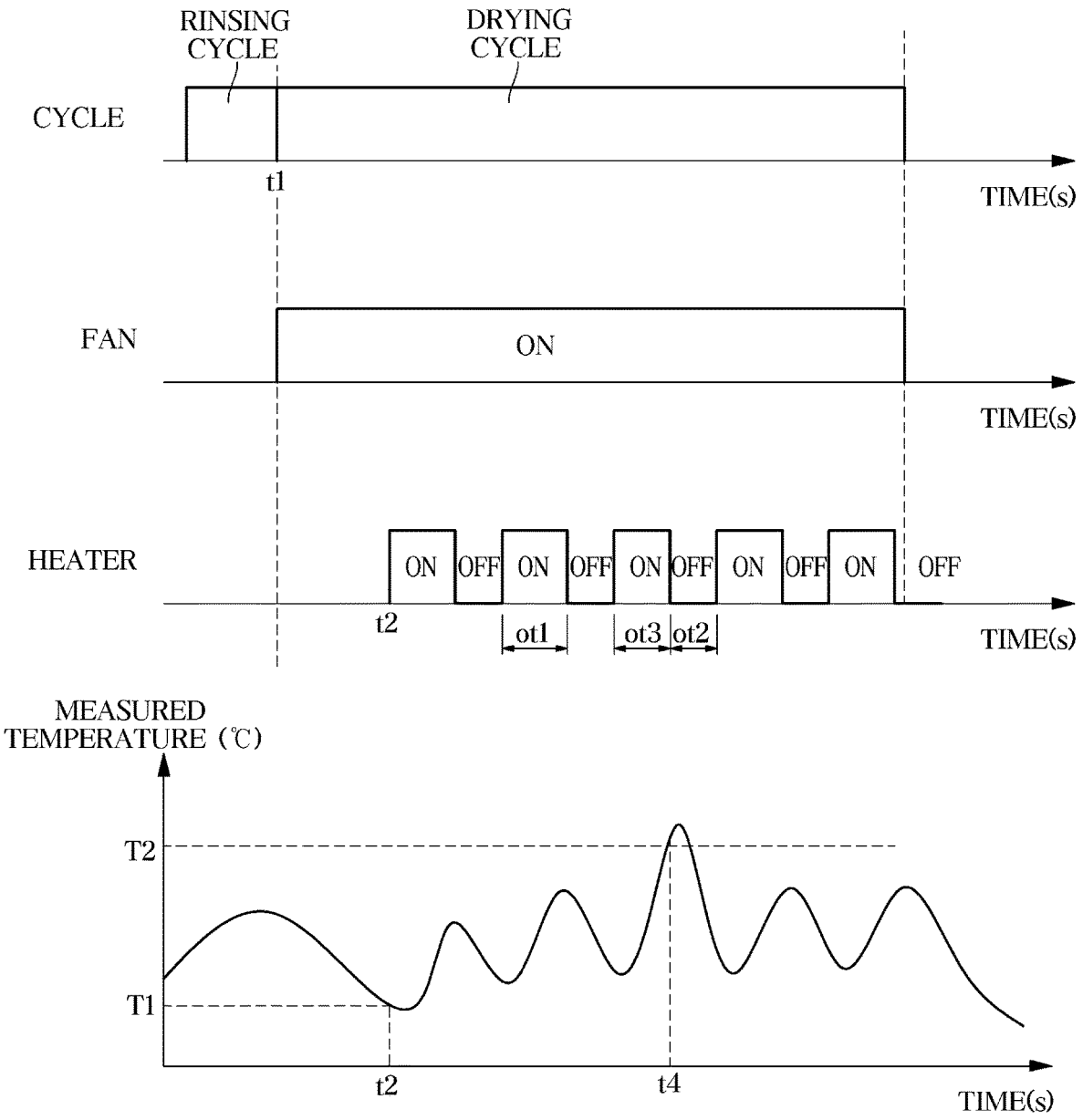
FIG. 14 is still another embodiment illustrating a state in which a reference temperature is exceeded while a heater is in ON-state during a drying cycle.

FIG. 10 is a flowchart illustrating a method for controlling a dishwasher during a drying cycle, according to various embodiments of the present disclosure. FIG. 11 illustrates an example of an operation of a drying device during a drying cycle of a dishwasher according to various embodiments. FIG. 12 is a diagram for describing a state in which a reference temperature is exceeded while a heater is in ON state during a drying cycle of a dishwasher according to various embodiments. FIG. 13 is another embodiment illustrating a state in which a reference temperature is exceeded while a heater is in ON state during a drying cycle. FIG. 14 is still another embodiment illustrating a state in which a reference temperature is exceeded while a heater is in ON state during a drying cycle.

Referring to FIGS. 11 to 14 in conjunction with FIG. 10, the processor 200 may, based on a start of the drying cycle (2000), operate the fan 131 (2100). In an embodiment, the processor 200 may operate the fan 131 at a start time t1 of the drying cycle, or may operate the fan 131 based on a preset period of time (e.g., 5 seconds) elapsing after the start of the drying cycle.

As described above, the operation time point of the fan 131 may be preset regardless of temperature information obtained from the temperature sensor 195.

On the other hand, in an embodiment, the processor 200 may determine an initial operation time point t2 of the heater 140 during the drying cycle based on the temperature information obtained from the temperature sensor 195.

For example, the processor 200 may, in response to the temperature measured by the temperature sensor 195 falling below a first reference temperature T1 (e.g., 55° C.) (YES in operation 2200), initially operate the heater 140. (2300). The temperature inside the washing chamber 20 heated in the rinsing water spraying cycle (1320) may be relatively high because the drying cycle is started after the rinsing cycle is finished. According to the embodiment, as the heater 140 is initially operated at the time point t2 when the temperature measured by the temperature sensor 195 falls below the first reference temperature T1, which allows for efficient utilization of the heat supplied in the rinsing cycle, leading to energy saving, and preventing damage to the housings 110 and 120 caused by heated air. In addition, according to the embodiment, operating the fan 131 before operating the heater 140 may secure the time for identifying whether the fan 131 malfunctions in advance. Also, according to the embodiment, the initial operation time point of the heater 140 may be varied according to the temperature of the rinsing water for each washing course.

According to various embodiments, the processor 200 may, in response to the temperature measured by the temperature sensor 195 at the start of the drying cycle being lower than or equal to than the first reference temperature T1 (e.g., 55° C.), operate the heater 140 simultaneously with the start of the drying cycle, or based on a predetermined time elapsing after the start of the drying cycle, operate the heater 140. According to another embodiment, the processor 200 may, regardless of the temperature measured by the temperature sensor 195, operate the heater 140 simultaneously with the start of the drying cycle or operate the heater 140 based on a predetermined time elapsing after the start of the drying cycle.

In an embodiment, the processor 200 may control on/off of the heater 140 based on the initial operation time point of the heater 140 (2400). According to various embodiments, the processor 200 may control on/off of the heater 140 by turning off the heater 140 for a preset time when the temperature measured by the temperature sensor 195 reaches a predetermined temperature and then turning on the heater 140 again.

According to various embodiments, the processor 200 may control the operation of the heater 140 based on temperature information obtained from the temperature sensor 195 after the heater 140 is operated.

In an embodiment, the processor 200 may, during the drying cycle (NO in operation 2550), repeat an operation of turning on the heater 140 for a first period ot1 (e.g., 3 minutes) and turning off the heater 140 for a second period ot2 (e.g., 2 minutes) until the temperature measured by the temperature sensor 195 reaches a second reference temperature (e.g., 85° C.) (NO in operation 2500). That is, the processor 200 may repeat an operation of turning on the heater for a preset ON-period ot1 and turning off the heater for a preset OFF-period ot2.

According to various embodiments, the processor 200 may set the first period ot1 and the second period ot2 such that a period during which the heater 140 is turned on is longer than a period during which the heater 140 is turned off.

When the period in which the heater 140 is turned on is longer than the period in which the heater 140 is turned off, the drying device 100 may more efficiently supply heat to the inside of the washing chamber 20, and thus the drying effect of dishes may be improved.

According to various embodiments, the processor 200 may set the first period ot1 and the second period ot2 based on the time interval that ends when the temperature measured by the temperature sensor 195 reaches a predetermined temperature (e.g., 80° C.) from the initial operation time point t2 of the heater 140. In an embodiment, the processor 200 may, in response to the temperature measured by the temperature sensor 195 during the drying cycle not reaching a second reference temperature T2 (e.g., 85° C.) (NO in operation 2500), repeat the operation of turning on the heater 140 for a first period (e.g., 3 minutes) and turning off the heater 140 for a second period (e.g., 2 minutes).

In an embodiment, the processor 200 may, in response to an end of the drying cycle (YES in operation 2550) without the temperature measured by the temperature sensor 195 during the drying cycle reaching the second reference temperature T2, turn off the operation of the heater 140 from a time point t3 when the drying cycle ends (2800).

Referring to FIG. 12, in an embodiment, the processor 200 may, in response to the temperature measured by the temperature sensor 195 during the ON-state of the heater 140 being exceeding the second reference temperature T2 (YES in operation 2500), turn off the operation of the heater 140 during the remaining time of the drying cycle (2600). That is, the processor 200 may turn off the heater 140 at a time point t4 when the temperature measured by the temperature sensor 195 exceeds the second reference temperature T2 while the heater 140 in an ON-state. Accordingly, a period ot3 during which the heater 140 is turned on for the last time may become shorter than the preset first period ot1.

In the case in which the heater 140 is turned off before a preset end time point of the drying cycle, the processor 200 may maintain the operation of the fan 131 for the remaining time of the drying cycle.

In an embodiment, the processor 200 may, in response to the temperature measured by the temperature sensor 195 during the On-state of the heater 140 being exceeding the second reference temperature T2 (YES in operation 2500), immediately end the drying cycle (2700).

According to the embodiment, the temperature in the vicinity of the outlet 192 of the drying device 100 may be maintained below a specific temperature, and maintained at an average temperature within a specific range, and thus the drying performance may be improved and the time required for the drying cycle may be reduced.

Referring to FIG. 13, according to various embodiments, the processor 200 may, in response to the temperature measured by the temperature sensor 195 during the ON-state of the heater 140 being exceeding the second reference temperature T2, turn off the operation of the heater 140 for a remaining time rt of the preset ON-period ot1 (e.g., 3 minutes). Accordingly, in response to the temperature measured by the temperature sensor 195 during the ON-state of the heater 140 being exceeding the second reference temperature T2, a period ot3 during which the heater 140 is turned on may be shorter than the preset ON period ot1.

For example, when it is assumed that the preset ON-period of the heater 140 is 3 minutes, and the temperature, which is measured by the temperature sensor 195 at a time point t4 when 2 minutes elapses after the heater 140 is switched from an OFF-state to an ON-state, exceeds the second reference temperature T2, the heater 140 may be turned off for the remaining time rt (1 minute), and maintained in the OFF state for the next preset OFF period ot2 (e.g., 2 minutes). Accordingly, in a specific proceeding of the on/off repetitions, the off period of the heater 140 may become longer. For example, in an embodiment, the off period of the heater 140 may become longer to a value corresponding to the sum of the remaining time based on the time point t4 when the temperature measured by the temperature sensor 195 exceeds the second reference temperature T2 and the preset off period ot2.

According to the embodiment, even when the drying cycle is not completed, the drying performance may be improved by efficiently maintaining an average temperature within a specific range.

Referring to FIG. 14, according to various embodiments, the processor 200 may, in response to the temperature measured by the temperature sensor 195 during the ON-state of the heater 140 being exceeding the second reference temperature T2, turn off the heater 140 for a remaining time of the preset ON-period (ot1; e.g., 3 minutes), and based on a preset OFF period ot2 (e.g., 2 minutes) elapsing from the point in time when the heater 140 is turned off, turn on the heater 40 again. Accordingly, in response to the temperature measured by the temperature sensor 195 during the ON-state of the heater 140 being exceeding the second reference temperature T2, the period ot3 during which the heater 140 is turned on may become shorter than the preset period ot1.

For example, while the preset on-period ot1 of the heater 140 is 3 minutes and the preset off-period ot2 of the heater 140 is 2 minutes, the heater, in response to the temperature measured by the temperature sensor 195 at a time point for when 2 minutes elapses after the heater 140 is switched from an OFF-state to an ON-state being exceeding the second reference temperature T2, may be turned off for a preset OFF period ot2, and thus the cycle time may be reduced by as much as 1 minute.

According to the embodiment, a safety accident due to overheating of the heater may be prevented, and the time required for the drying cycle may be shortened.

Figure 15:
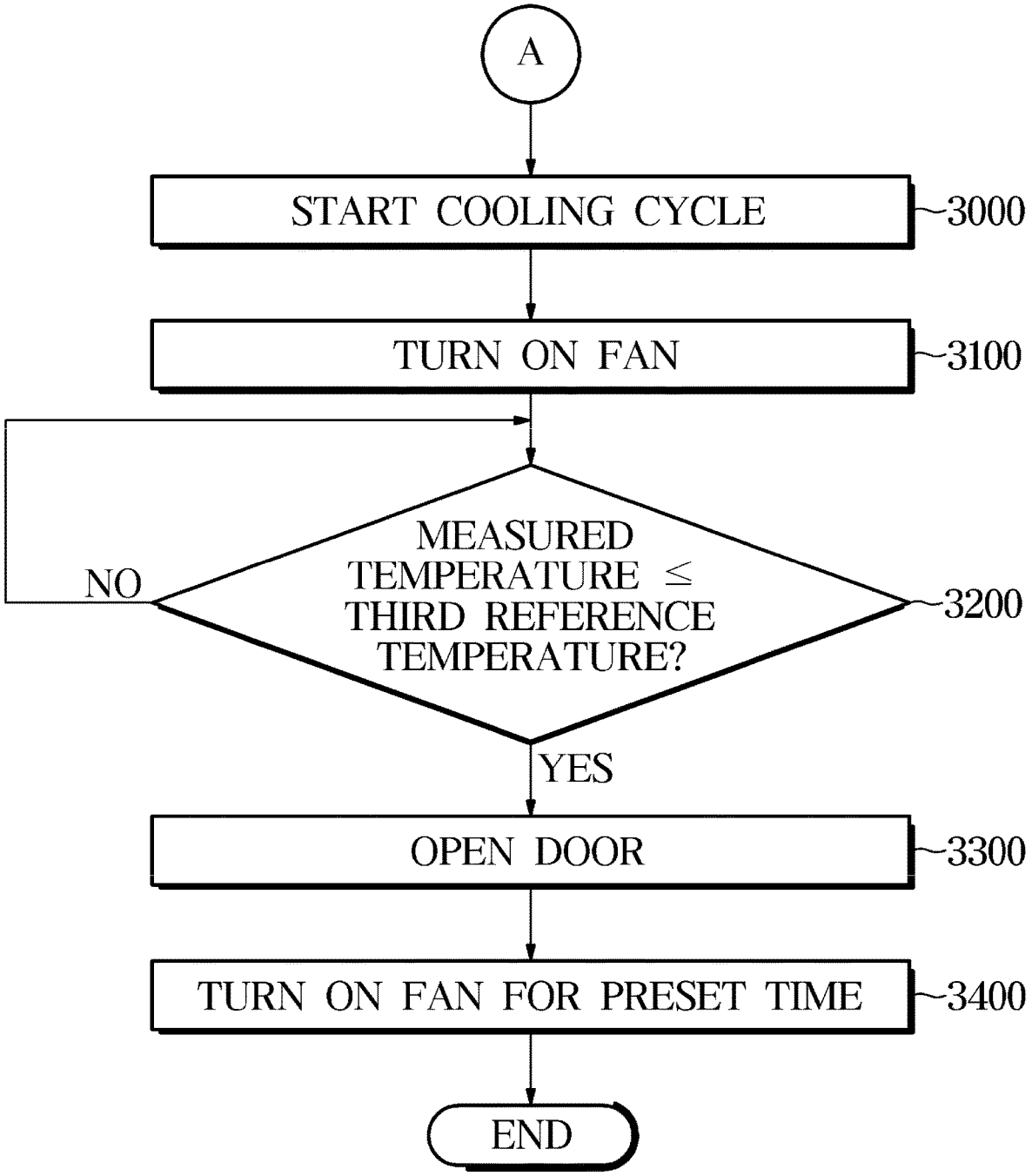
FIG. 15 is a flowchart showing a method for controlling a dishwasher during a cooling cycle according to various embodiments of the present disclosure.
Figure 16:
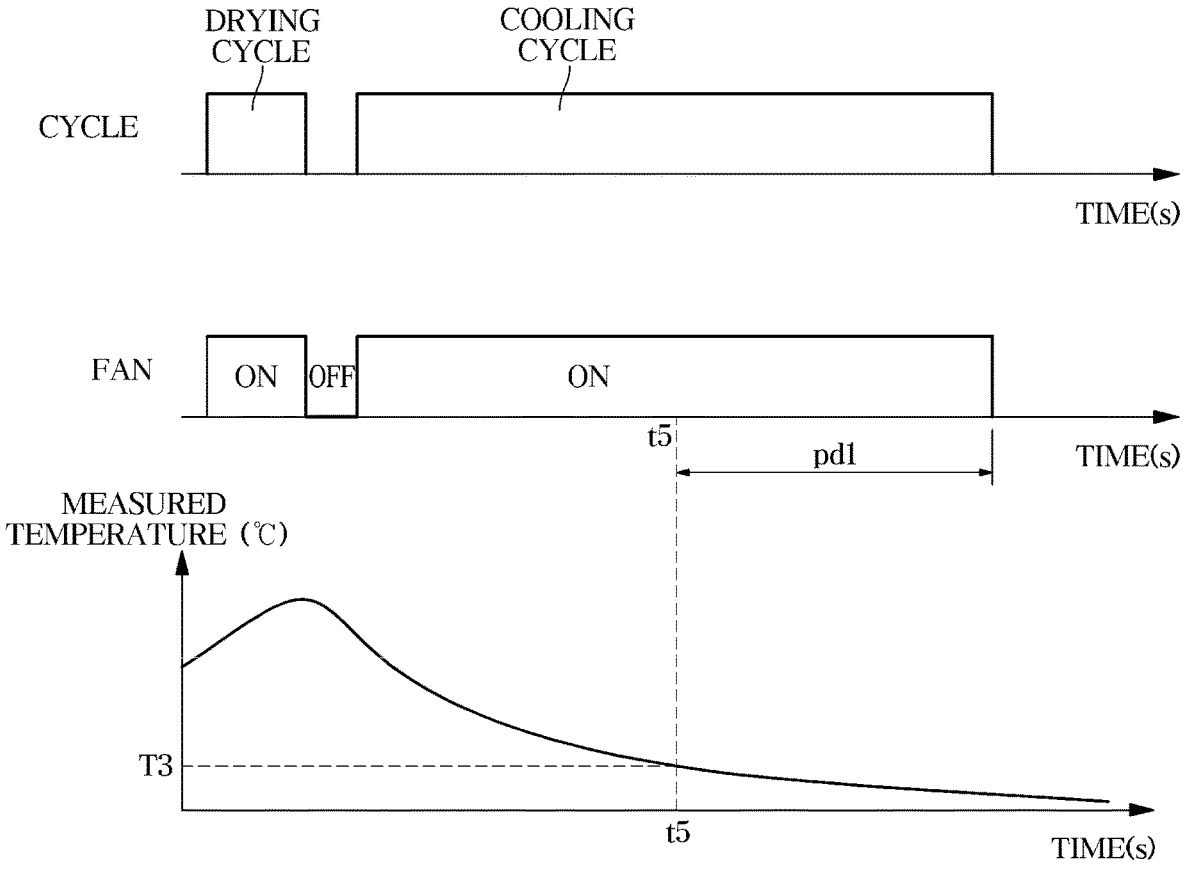
FIG. 16 is a diagram for describing a state in which a cooling cycle of a dishwasher starts according to various embodiments.

FIG. 15 is a flowchart showing a method for controlling a dishwasher during a cooling cycle according to various embodiments of the present disclosure. FIG. 16 is a diagram for describing a state in which a cooling cycle of a dishwasher starts according to various embodiments.

Referring to FIGS. 15 and 16, the processor 200 may control components (e.g., the drying device 100) of the dishwasher 1 to start a cooling cycle when the drying cycle ends (3000).

In an embodiment, the processor 200 may temporarily turn off the fan 131 in response to the end of the drying cycle, and may operate the fan 131 again based on the start of the cooling cycle (3100).

According to various embodiments, the processor 200 may continuously operate the fan 131 even after the drying cycle ends.

As the fan 131 continuously rotates during the cooling cycle, the temperature inside the washing chamber 20 may be effectively lowered, and the drying performance of dishes inside the washing chamber 20 may be improved.

Since hot air is supplied to the inside of the washing chamber 20 in the drying cycle, the drying cycle may be completed with the inside the washing chamber 20 at the elevated temperature. Accordingly, when a user desires to take out dishes from the inside of the dishwasher 1, a safety accident due to high temperature may occur.

The dishwasher 1 according to various embodiments may include a door opening device for automatically opening the door 14 or may not include a door opening device.

In an embodiment, the processor 200 may, in response to the temperature measured by the temperature sensor 195 falling below a third reference temperature T3 (e.g., 35° C.) (YES in operation 3200), turn off the fan 131, thereby ending the cooling process. That is, the processor 200 may operate the fan 131 until the temperature measured by the temperature sensor 195 falls below the third reference temperature T3.

The processor 200 may, when the cooling process ends, notify the outside of the end of the washing course through the output module 420.

In another embodiment, the processor 200 may, based on a time point t5 at which the temperature measured by the temperature sensor 195 falls below the third reference temperature T3 (e.g., 35° C.), control the door opening device to open the door 14 (3300).

The processor 200 may notify the outside that the door 14 is open through the output module 420.

The processor 200 may operate the fan 131 for a preset time pd1 after the door 14 is opened (3400).

According to an embodiment, when the fan 131 is operated while the door 14 is open, since the efficiency of circulation between the outside air and the air inside the washing chamber 20 is improved, the drying performance may be improved by operating the fan 131 for a preset time pd1 after the door 14 is opened.

The processor 200 may notify the outside of the end of the washing course through the output module 420 when the preset time pd1 has elapsed.

According to various embodiments, since the tableware is provided at a sufficiently lowered temperature at a time when the user recognizes the end of the washing course through the output module 420, safety accidents due to high temperatures may be prevented.

In an embodiment, the processor 200 may operate the fan 131 for a preset period of time a preset number of times before the drying cycle starts.

For example, the processor 200 may operate the fan 131 during a cycle in which there is no concern of water inflow into the flow channel 190, such as during a washing water draining operation in the preliminary washing cycle (1100) and/or a washing water draining operation (1230) in the main washing cycle (1200) and/or a rinsing water draining operation (1330) in the rinsing cycle (1300).

The processor 200 may operate the fan 131 before the start of the drying cycle, and detect a driving current applied to the fan 131 to identify whether the fan 131 malfunctions. When the fan 131 is identified as malfunctioning before the drying cycle (1400) starts or before the heater 140 operates, the drying cycle (1400) may be omitted.

For example, the processor 200 may, upon receiving an input for selecting a washing course and/or option and an input for starting the course through the user interface 400, operate the fan 131 and detect power applied to the fan 131 to identify whether the fan 131 malfunctions. In an embodiment, the processor may, upon identifying a malfunction of the fan 131 before the rinsing cycle 1300 starts, set the rinsing water temperature in the rinsing cycle 1300 to become higher, rather than omitting the drying cycle 1400, to increase the drying efficiency.

For example, when it is identified that the fan 131 malfunctions before the rinsing cycle 1300 starts, the processor 200 may switch to the drying enhancement option from the hot air drying option.

In an embodiment, the processor 200 may, upon identifying a malfunction of the fan 131 before the rinsing cycle 1300 starts, inquire with the user about an intention whether to switch to the drying enhancement option through the output module 420, and also inquire with the user about an intention whether to change to the drying enhancement option via an external electronic device (e.g., a user terminal) through a communication module.

As another example, the processor 200 may operate the fan 131 after the last rinsing water spraying operation in the rinsing cycle 1300 ends and before the drying cycle 1400 starts, or immediately after the drying cycle 1400 starts, and detect the driving current applied to the fan 131 to identify whether the fan 131 malfunctions. In an embodiment, upon identifying a malfunction of the fan 131 after completion of the rinsing cycle 1300, the processor 200 may turn off the heater 140 and the fan 131 to maintain a standby mode without any operation for a period corresponding to the drying cycle (1400).

In addition, the processor 200 may, upon identifying that the fan 131 malfunctions, notify the outside of the malfunction of the fan, 131 through the output module 420, or notify the outside of the malfunction of the fan 131 through an external electronic device (e.g., a user device) using a communication module. In addition, the processor 200 may notify that the "hot air drying option" has been changed to the "drying enhancement option" according to the malfunction of the fan 131 or notify that the operation for the drying cycle 1400 has been changed (e.g., to a standby mode) through the output module 420 and/or the communication module.

According to various embodiments, the processor 200 may operate the fan 131 at some time point between when a start command for performing the washing cycle is received from the user through the input module 410 and when the rinsing cycle 1300 starts, to identify a malfunction of the fan 131. In this case, upon identifying that the fan 131 malfunctions, the processor 200 may set the rinsing water temperature in the rinsing cycle 1300 to become higher, and keep the fan 131 and the heater 140 turned off in the drying cycle 1400.

In addition, the processor 200 may operate the fan 131 at some point between when the rinsing cycle 1300 starts and immediately after the drying cycle 1400 starts to identify whether the fan 131 malfunctions, and upon identifying that the fan 131 malfunctions, turn off the heater 140 and the fan 131 such that a standby mode is maintained without any operation being performed for a period corresponding to the drying cycle 1400.

According to the embodiment, whether the fan 131 malfunctions may be identified before the drying cycle starts, and thus an accident that may occur due to the non-operation of the fan 131 during the drying cycle may be prevented.

FIG. 17 is a diagram for describing the temperature of rinsing water of a dishwasher according to various embodiments of the present disclosure;

As described above, the temperature of the rinsing water used in the rinsing cycle 1300 may act as an important factor in optimizing drying performance.

Accordingly, in order to efficiently improve the drying performance, it is required to optimally adjust the temperature of the rinsing water as well as optimally controlling the drying device 100.

Referring to FIG. 17, preset rinsing water target temperatures for each washing course may vary. For example, the preset rinsing water target temperature corresponding to the first washing course (e.g., a standard course) may be the first temperature A (e.g., 55° C.), and the preset rinsing water target temperature corresponding to the second washing course (e.g., an intensive course) may be the second temperature B (e.g., 65° C.).

In an embodiment, the target temperature of the rinsing water may refer to the temperature of the rinsing water used in the last rinsing water spraying operation, performed immediately before the rinsing water draining cycle 1330, of the rinsing water spraying cycle 1320.

According to various embodiments, the dishwasher 1 may provide a first option (a hot air drying option).

Also, according to embodiments, the dishwasher 1 may provide a second option (a drying enhancement option).

According to the embodiment, the target temperature of the rinsing water when the user selects the first washing course along with the first option or the second option may be changed compared to a case in which only the first washing course is selected without adding an option.

Similarly, the target temperature of the rinsing water when the user selects the second washing course along with the first option or the second option may be changed compared to a case in which only the second washing course is selected without adding an option.

In an embodiment, the processor 200 may, in response to receiving a user input for selecting the first washing course through the user interface 400, set the target temperature of the rinsing water used in the rinsing cycle to the first temperature A, and in response to receiving a user input for selecting the second washing course, set the target temperature of the rinsing water used in the rinsing cycle to the second temperature B, and in response to receiving a user input for selecting the first washing course and a user input for adding the first option, set the target temperature of the rinsing water to a temperature A+A1 higher than the first temperature A by a first preset temperature A1, and in response to receiving a user input for selecting the second washing course and a user input for adding the first option, set the target temperature of the rinsing water to a temperature B+B1 higher than the second temperature B by a second preset temperature B1.

That is, when the user selects the first washing course and the first option, the target temperature of the rinsing water may be set to the temperature A+A1 higher than the first temperature A by the first preset temperature A1, and when the user selects the second washing course and the first option, the target temperature of the rinsing water may be set to the temperature B+B1 higher than the second temperature B by the second preset temperature B1.

In an embodiment, when selecting the first option for each washing course, the increase of the target temperature of the rinsing water may vary.

That is, the first preset temperature A1 may be different from the second preset temperature B1. For example, when the target temperature A of the rinsing water of the first washing course is lower than the target temperature B of the rinsing water of the second washing course, the first preset temperature A1 (e.g., 10° C.) may be higher than the second preset temperature B1 (e.g., 7° C.).

Also, in an embodiment, the first preset temperature A1 and the second preset temperature B1 may be set to be lower than or equal to 15° C.

According to the embodiment, when the hot air drying option is selected for each washing course, the increase range of the target temperature of the rinsing water is differently restricted, thereby improving energy efficiency and drying performance.

According to various embodiments, the processor 200 may, in response to receiving a user input for selecting a first washing course and a user input for adding a second option, set the target temperature of the rinsing water to a temperature A+A2 higher than the first temperature A by a third preset temperature A2, and in response to receiving a user input for selecting a second washing course and a user input for adding a second option, set the target temperature of the rinsing water to a temperature B+B2 higher than the second temperature B by a fourth preset temperature B2.

That is, when the user selects the first washing course and the second option, the target temperature of the rinsing water may be set to the temperature A+A2 higher than the first temperature A by the third preset temperature A2, and when the user selects the second washing course and the second option, the target temperature of the rinsing water may be set to the temperature B+B2 higher than the second temperature B by the fourth preset temperature B2.

The second option is an option that greatly increases the temperature of the rinsing water used in the last rinsing water spraying operation of the rinsing water spraying cycle (1320) to improve drying performance using latent heat of dishes.

In an embodiment, the third preset temperature A2 may be higher than the first preset temperature A1, and the fourth preset temperature B2 may be higher than the second preset temperature B1.

According to the embodiment, the dishwasher 1 may, in the case of selecting the hot air drying option, restrict the increase range of the target temperature of the rinsing water at an extent greater than that in the case of selecting the drying enhancement option, thereby achieving energy saving while improving drying performance.

The various embodiments of the disclosure and terminology used herein are not intended to limit the technical features of the disclosure to the specific embodiments, but rather should be understood to cover all modifications, equivalents, and alternatives falling within the concept and scope of the disclosure. In the description of the drawings, like numbers refer to like elements throughout the description of the drawings.

The singular forms preceded by "a," "an," and "the" corresponding to an item are intended to include the plural forms as well unless the context clearly indicates otherwise. In the disclosure, a phrase such as "A or B," "at least one of A and B," "at least one of A or B," "A, B or C," "at least one of A, B and C," and "at least one of A, B, or C" may include any one of the items listed together in the corresponding phrase of the phrases, or any possible combination thereof. As used herein, such terms as "1st" and "2nd," or "first" and "second" may be used to simply distinguish a corresponding component from another, and does not limit the components in other aspect (for example, importance or order). When one (e.g., a first) element is referred to as being "coupled" or "connected" to another (e.g., a second) element with or without the term "functionally" or "communicatively," it means that the one element is connected to the other element directly (e.g., by wire), wirelessly, or via a third element.

The term, "~ module" may refer to a unit implemented in hardware, software, or firmware. For example, the term "module" may be interchangeably used with terms, such as, logic, logic blocks, components, or circuits. The module may be an integrally configured component or a minimum unit or part of the integrally configured component that performs one or more functions. For example, according to an embodiment, the module may be implemented in the form of an application-specific integrated circuit (ASIC).

The various embodiments of the present disclosure may be realized by software (e.g., a program) including one or more instructions stored in a machine-readable storage media (e.g., an internal memory 300 or an external memory) that may be read by a machine (e.g., a dishwasher 1). For example, a machine (e.g., a processor (e.g., a processor 200 of the washing machine 1)) may invoke at least one of instructions stored in the storage medium and execute the at least one invoked instruction, which allows at least one function to be performed in accordance with the invoked instruction. The one or more instructions may include codes generated by a compiler or codes executable by an interpreter. The machine-readable storage medium may be provided in the form of a non-transitory storage medium. Here, when a storage medium is referred to as "non-transitory," it may be understood that the storage medium is tangible and does not include a signal, but rather that data is semi-permanently or temporarily stored in the storage medium.

According to an embodiment, the methods according to the various embodiments disclosed herein may be provided in a computer program product. The computer program product may be traded between a seller and a buyer as a product. The computer program product may be distributed in the form of a machine-readable storage medium (e.g., compact disc read only memory (CD-ROM)), or may be distributed directly between two user devices (e.g., a dishwasher 1 and a smartphone) through an application store (e.g., Play Store™), or online (e.g., downloaded or uploaded). In the case of online distribution, at least a portion of the computer program product may be stored at least semi-permanently or may be temporarily generated in a machine-readable storage medium, such as a memory of a server of a manufacturer, a server of an application store, or a relay server.

According to the various embodiments, each of the above-described elements (e.g., a module or a program) may include a singular or plural entity, and some of the plurality of entities may be distributed in other elements. According to various embodiments, one or more of the above described elements or operations may be omitted, or one or more other elements or operations may be added. Alternatively or additionally, a plurality of elements (e.g., modules or programs) may be integrated into one element. In this case, the integrated element may perform one or more functions of each of the plurality of elements in the same or similar manner as that performed by the corresponding element of the plurality of components before the integration. According to various embodiments, operations performed by a module, program, or other elements may be executed sequentially, in parallel, repeatedly, or heuristically, or one or more of the operations may be executed in a different order, or omitted, or one or more other operations may be added.

What is claimed is:

1. A dishwasher comprising:

a tub forming a washing chamber;

an input module including:

a first button for receiving a first user input for selecting a first washing course, a second button for receiving a second user input for selecting a second washing course, and a third button for receiving a third user input for selecting a hot air drying option;

a drying device including:

a heater to heat air, and a fan that is operable to cause air heated by the heater to discharge to the washing chamber through an outlet, and at least one processor configured to:

operate the dishwasher to perform a first washing course based on receiving the first user input;

operate the dishwasher to perform a second washing course based on receiving the second user input; and operate the dishwasher to perform a drying cycle after one of the first or the second washing course based on the hot air drying option being selected by the third user input, wherein the at least one processor is further configured to operate the fan based on a start of a drying cycle and to turn on the heater based on a first predetermined time being elapsed after the start of the drying cycle.

2. The dishwasher of claim 1, wherein the at least one processor is configured to set a first rinsing water temperature corresponding to the first washing course being different from a second rinsing water temperature corresponding to the second washing course.

3. The dishwasher of claim 1, wherein the at least one processor is configured to operate the fan to be maintained in turn-on state while the heater is turned off based on a second predetermined time being elapsed before terminating the drying cycle.

4. The dishwasher of claim 1, further comprising:

a temperature sensor configured to detect a temperature of the air heated by the heater, wherein the at least one processor is configured to control on/off of the heater to prevent the temperature detected by the temperature sensor from exceeding a reference temperature during the drying cycle.

5. The dishwasher of claim 4, wherein the at least one processor is configured to control on/off of the heater so that a period during which the heater is turned on is longer than a period during which the heater is turned off.

6. The dishwasher of claim 4, wherein the at least one processor is configured to, in response to the temperature detected by the temperature sensor with the heater in an ON state exceeding the reference temperature, turn off the heater for a remaining time of the drying cycle.

7. The dishwasher of claim 4, wherein the at least one processor is configured to:

repeat an operation of turning on the heater for a preset on-period and turning off the heater for a preset off-period, and in response to the temperature detected by the temperature sensor with the heater in an ON state exceeding the reference temperature, turn off the heater for a remaining time of the preset on-period of the heater.

8. The dishwasher of claim 1, further comprising:

a temperature sensor configured to detect a temperature of the air heated by the heater, wherein the at least one processor is configured to initially operate the heater in response to the temperature detected by the temperature sensor falling below a reference temperature.

9. The dishwasher of claim 1, further comprising:

a temperature sensor configured to detect a temperature of the air heated by the heater, wherein the at least one processor is configured to:

initially operate the heater in response to the temperature detected by the temperature sensor falling below a first reference temperature, control on/off of the heater to prevent the temperature detected by the temperature sensor from exceeding a second reference temperature, and turn off the heater for a remaining time of the drying cycle in response to the temperature detected by the temperature sensor with the heater in an ON state exceeding the second reference temperature.

10. The dishwasher of claim 1, further comprising:

a temperature sensor configured to detect a temperature of the air heated by the heater, wherein the at least one processor is configured to, in response to an end of the drying cycle, turn off the heater and operate the fan until the temperature detected by the temperature sensor falls below a reference temperature.

11. The dishwasher of claim 1, further comprising:

a temperature sensor configured to detect a temperature of the air heated by the heater, wherein the dishwasher includes a door configured to open and close the washing chamber, and the at least one processor is configured to, in response to an end of the drying cycle, turn off the heater and, in response to the temperature detected by the temperature sensor falling below a reference temperature, open the door.

12. The dishwasher of claim 11, wherein the at least one processor is configured to operate the fan for a preset time after the door is opened.

13. The dishwasher of claim 1, wherein the at least one processor is configured to operate the fan for a preset time by a preset number of times before the drying cycle starts.

14. The dishwasher of claim 13, wherein the at least one processor is configured to, upon determining that the fan malfunctions before the drying cycle starts, omit the drying cycle.

15. The dishwasher of claim 1, wherein the input module further includes:

a fourth button for receiving a fourth user input for enhancing a drying performance without adding the drying cycle for a selected washing course, wherein the at least one processor is configured to:

in response to receiving the first user input, set a target temperature of rinsing water used in a rinsing cycle to a first temperature, in response to receiving the first user input and the third user input, set a target temperature of the rinsing water to a second temperature higher than the first temperature by a first preset temperature, and in response to receiving the first user input and the fourth user input, set a target temperature of the rinsing water to a third temperature higher than the first temperature by a second preset temperature, wherein the first preset temperature is lower than the second preset temperature.

16. The dishwasher of claim 1, wherein the at least one processor is configured to:

in response to receiving the first user input, set a target temperature of rinsing water used in a rinsing cycle to a first temperature, in response to receiving the second user input, set a target temperature of rinsing water used in a rinsing cycle to a second temperature, in response to receiving the first user input and the third user input, set a target temperature of the rinsing water to a third temperature higher than the first temperature by a first preset temperature, and in response to receiving the second user input and the third user input, set a target temperature of the rinsing water to a fourth temperature higher than the second temperature by a second preset temperature, wherein the first preset temperature is different from the second preset temperature.

17. A method of operating a dishwasher that includes a tub forming a washing chamber, and a drying device including a heater to heat air and a fan that is operable to cause the air heated by the heater to be discharged to the washing chamber, the method comprising:

receiving a user input to select a washing course of a plurality of washing courses of the dishwasher;

receiving a user input to add a drying cycle to the selected washing course;

operating the dishwasher to perform the selected washing course; and after the selected washing course is performed, operating the dishwasher to perform a drying cycle in which the fan is operated based on a start of the drying cycle, and the heater is turned on based on a first predetermined time being elapsed after the start of the drying cycle.

* * * * *